US008292721B1

(12) United States Patent
Watanabe

(10) Patent No.: US 8,292,721 B1
(45) Date of Patent: Oct. 23, 2012

(54) GAME MACHINE

(75) Inventor: Naoyuki Watanabe, Aichi (JP)

(73) Assignee: Kyoraku Industrial Co., Ltd., Aichi (JP)

( * ) Notice: Subject to any disclaimer, the term of this patent is extended or adjusted under 35 U.S.C. 154(b) by 0 days.

(21) Appl. No.: 13/183,091

(22) Filed: Jul. 14, 2011

(51) Int. Cl.
*A63F 9/24* (2006.01)

(52) U.S. Cl. ..... 463/17; 463/20; 463/25

(58) Field of Classification Search ..... 463/16–17, 463/25–30; 273/292
See application file for complete search history.

(56) References Cited

U.S. PATENT DOCUMENTS

| | | | | |
|---|---|---|---|---|
| 2007/0265056 | A1* | 11/2007 | Yoshizawa | 463/17 |
| 2008/0032761 | A1* | 2/2008 | Seelig et al. | 463/16 |
| 2008/0070671 | A1 | 3/2008 | Okada | 463/20 |
| 2008/0076510 | A1* | 3/2008 | Ito et al. | 463/17 |
| 2008/0182643 | A1* | 7/2008 | Seelig et al. | 463/20 |
| 2009/0005151 | A1* | 1/2009 | Seelig et al. | 463/20 |
| 2009/0082086 | A1* | 3/2009 | Seelig et al. | 463/20 |
| 2009/0318207 | A1* | 12/2009 | Okuaki et al. | 463/2 |
| 2010/0210347 | A1* | 8/2010 | Seelig et al. | 463/20 |

FOREIGN PATENT DOCUMENTS

| | | |
|---|---|---|
| JP | 2008-062046 | 3/2008 |

* cited by examiner

*Primary Examiner* — Masud Ahmed
(74) *Attorney, Agent, or Firm* — Ladas & Parry, LLP

(57) ABSTRACT

A game machine includes: a game board provided with a playfield on which playing balls cascade downward; a ball receiving hole detection part which detects whether or not a playing ball enters a ball receiving hole provided in the playfield; a special movable bonus game gate device which is able to switch between an open state and a closed state; a lottery part which holds a lottery in which one result of the lottery is obtained from a plurality of results at least including a bonus game; and a game value providing part configured to provide a first game value based on the special movable bonus game gate device being open when the result of the lottery by the lottery part is win; and a special lottery part which holds a special lottery to determine whether or not to provide a second game value different from the first game value.

12 Claims, 23 Drawing Sheets

*FIG.9*

| RANDOM NUMBER FOR DETERMINING SPECIAL SYMBOL (0～999) | RESULT OF DETERMINATION | PROPORTION (REFERENCE) |
|---|---|---|
| 7、33、77 | WIN | 3/1000≒1/333.3 |
| 100～699 | SMALL WIN | 600/1000≒1/1.67 |
| OTHERS | LOSS | 397/1000≒1/2.52 |

FIG.10 A

| RANDOM NUMBER FOR BONUS GAME SYMBOL (0~99) | SPECIAL SYMBOL | STOPPED SYMBOL DATA | PERFORMANCE SYMBOL SPECIFYING COMMAND | | VALUE OF CREDIT (REFERENCE) |
|---|---|---|---|---|---|
| | | | MODE | DATA | |
| 0~32 | PECIAL SYMBOL 1 (FIRST BONUS GAME) | 01 | E0H | 01H | 6000 |
| 33~99 | SPECIAL SYMBOL 2 (SECOND BONUS GAME) | 02 | E0H | 02H | 3000 |

FIG.10 B

| RANDOM NUMBER FOR SMALL WIN SYMBOL (0~99) | SPECIAL SYMBOL | STOPPED SYMBOL DATA | PERFORMANCE SYMBOL SPECIFYING COMMAND | | VALUE OF CREDIT (REFERENCE) |
|---|---|---|---|---|---|
| | | | MODE | DATA | |
| 0~4 | SPECIAL SYMBOL A (SMALL WIN A) | 03 | E0H | 03H | 100 |
| 5~14 | SPECIAL SYMBOL B (SMALL WIN B) | 04 | E0H | 04H | 50 |
| 15~49 | SPECIAL SYMBOL C (SMALL WIN C) | 05 | E0H | 05H | 10 |
| 50~99 | SPECIAL SYMBOL D (SMALL WIN D) | 06 | E0H | 06H | 5 |

FIG.10 C

| SPECIAL SYMBOL | STOPPED SYMBOL DATA | PERFORMANCE SYMBOL SPECIFYING COMMAND | |
|---|---|---|---|
| | | MODE | DATA |
| SPECIAL SYMBOL 0 (LOSS) | 00 | E0H | 00H |

FIG.11 A

| RECEIVED PERFORMANCE SYMBOL SPECIFYING COMMAND | | SPECIAL SYMBOL | PERFORMANCE SYMBOL DATA | | | CONTENT OF PERFORMANCE SYMBOL |
|---|---|---|---|---|---|---|
| MODE | DATA | | | | | |
| E0H | 01H | SPECIAL SYMBOL 1 (FIRST BONUS GAME) | 01H | 01H | 01H | 7−7−7 |
| E0H | 02H | SPECIAL SYMBOL 2 (SECOND BONUS GAME) | 02H | 02H | 02H | 3−3−3 |

FIG.11 B

| RECEIVED PERFORMANCE SYMBOL SPECIFYING COMMAND | | SPECIAL SYMBOL | PERFORMANCE SYMBOL DATA | | | CONTENT OF PERFORMANCE SYMBOL |
|---|---|---|---|---|---|---|
| MODE | DATA | | | | | |
| E0H | 03H | SPECIAL SYMBOL A (SMALL WIN A) | 03H | 03H | 03H | 2−2−2 |
| E0H | 04H | SPECIAL SYMBOL B (SMALL WIN B) | 04H | 04H | 04H | 6−6−6 |
| E0H | 05H | SPECIAL SYMBOL C (SMALL WIN C) | 05H | 05H | 05H | 8−8−8 |
| E0H | 06H | SPECIAL SYMBOL D (SMALL WIN D) | 06H | 06H | 06H | ANY−ANY−4 |

GAME MACHINE

CROSS-REFERENCE TO RELATED APPLICATIONS

This application claims priority of Japanese Patent Application No. 2011-126746 filed on Jun. 6, 2011, the disclosure of which is incorporated herein by reference.

BACKGROUND

1. Field of the Invention

The present invention relates to a game machine.

2. Description of the Related Art

Conventionally, a slot machine using coins and medals disclosed in, for example, Japanese Patent Application Laid-Open Publication No. 2008-62046, has been popular in amusement places such as a game arcade and a casino. With such game machine, a player first inserts a predetermined number of coins in the game machine to determine the wager for a game and then starts a game. Upon starting the game, reels (including images presenting reels in a video slot machine) start rotating, and, when the reels stop, coins may be paid out according to a specific display condition (for example, the same specific symbols are stopped and displayed). To be more specific, upon starting a game, a lottery is held and the player's win or loss is determined. Then, if the result of the lottery is loss, any coin is not paid out, and, on the other hand, if the result of the lottery is win, a predetermined number (e.g. 100) of coins are paid out.

However, the above-described slot machine has a problem that the player gets bored due to a monotonous game flow, where a lottery is held at the time of start of a game to make a flow of the game, and this flow is repeated.

SUMMARY

Therefore, in view of the above-described problem, it is an advantage of an aspect of the present invention to provide a game machine that can prevent players from getting bored due to the monotonous flow of a game.

According to a first aspect of the present invention, a game machine includes: a game board provided with a playfield on which playing balls cascade downward; a ball receiving hole detection part configured to detect whether or not a playing ball enters a ball receiving hole provided in the playfield; a special movable bonus game gate device configured to be able to switch between an open state where the playing ball easily enters a special bonus game gate provided in the playfield and a closed state where the playing ball hardly enters the special bonus game gate; a lottery part configured to hold a lottery in which one result of the lottery is obtained from a plurality of results at least including a bonus game, the bonus game opening the special movable bonus game gate device when the ball receiving hole detection part detects the playing ball entering; and a game value providing part configured to provide a first game value based on the special movable bonus game gate device being open when the result of the lottery by the lottery part is to acquire the bonus game; and a special lottery part configured to hold a special lottery to determine whether or not to provide a second game value different from the first game value, in addition to the first game value which is provided by the game value providing part when the result of the lottery by the lottery part is to acquire the bonus game.

According to a second aspect of the present invention, the game machine further includes a special bonus game gate detection part configured to detect whether or not the playing ball enters the special bonus game gate. The game value providing part provides the first game value on condition that the special bonus game gate detection part detects the playing ball entering; and the special lottery part holds the special lottery to determine whether or not to provide the second game value different from the first game value, in addition to the first game value which is provided by the game value providing part, on condition that the special bonus game gate detection part detects the playing ball entering.

According to a third aspect of the present invention, the game machine further includes a special value providing part configured to provide one of the first game value and a third game value different from the first game value, when it is determined that the second game value is provided at the special lottery by the special lottery part.

According to a fourth aspect of the present invention, the game machine further includes a lottery right providing part configured to give a right to hold a second special lottery to determine whether or not to provide one of the first game value and a third game value when it is determined that the second game value is provided at the special lottery by the special lottery part.

According to a fifth aspect of the present invention, the special value providing part provides a game medium which can be converted into a predetermined number of playing balls as the third game value.

According to a sixth aspect of the present invention, the special value providing part provides a game medium which cannot be converted into a predetermined number of playing balls as the third game value.

According to a seventh aspect of the present invention, the game machine further includes: a variable display part including a variable display portion configured to be able to variably display a plurality of kinds of identification symbols in a display area, the identification symbols being arranged in a predetermined order; and a variable display control part configured to variably display the identification symbols on the variable display portion at the time of start of the lottery by the lottery part, and stop and display a combination of the identification symbols corresponding to the result of the lottery by the lottery part on the variable display portion after a predetermined period of time has elapsed. The variable display control part stops and displays a first combination when the result of the lottery by the lottery part is to acquire the bonus game, the first combination including one of a combination of a same identification symbols and a plurality of identification symbols, which corresponds to the bonus game.

According to an eights aspect of the present invention, the game machine further includes a performance execution part in one of the variable display part and a display part different from the variable display part, the performance execution part executing a special lottery suggestion performance which suggests that the special lottery is being held.

According to a ninth aspect of the present invention, the special lottery part holds the special lottery in addition to the lottery by the lottery part when the ball receiving hole detection part detects the playing ball entering.

According to the present invention, even if a bonus game is being held, another special lottery which can provide an additional game value is held. Therefore, a player can be more excited even if having acquired a bonus game.

BRIEF DESCRIPTION OF THE DRAWINGS

FIG. 9 shows a bonus game determination table;

FIG. 10 shows a symbol determination table;

FIG. 11 shows a performance symbol determination table;

DETAILED DESCRIPTION

Now, an embodiment of the present invention will be described in detail with reference to the drawings.

(The Configuration of a Game Machine)

Figure 1:
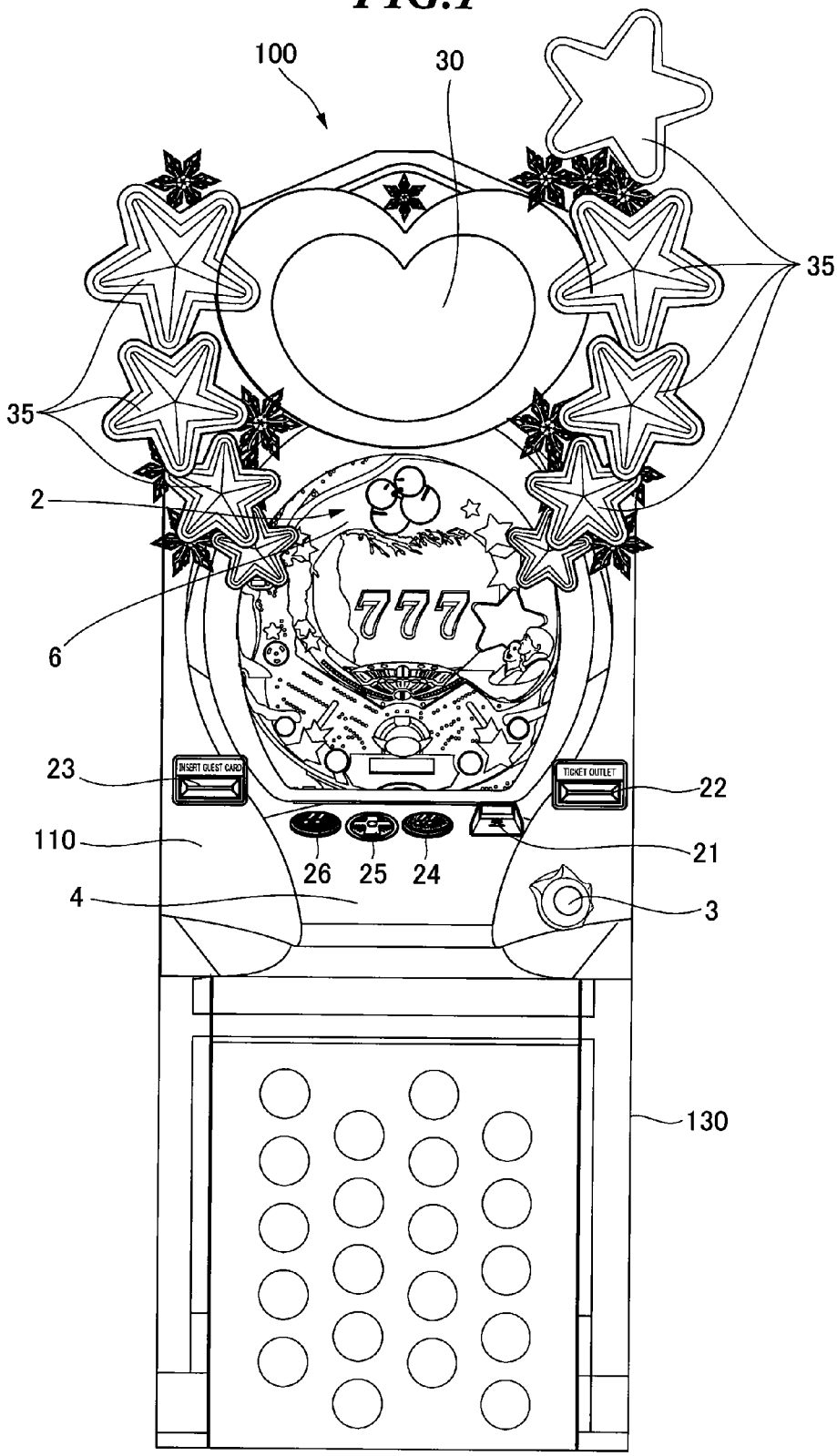
FIG. 1 is a front view showing a game machine.
Figure 2:
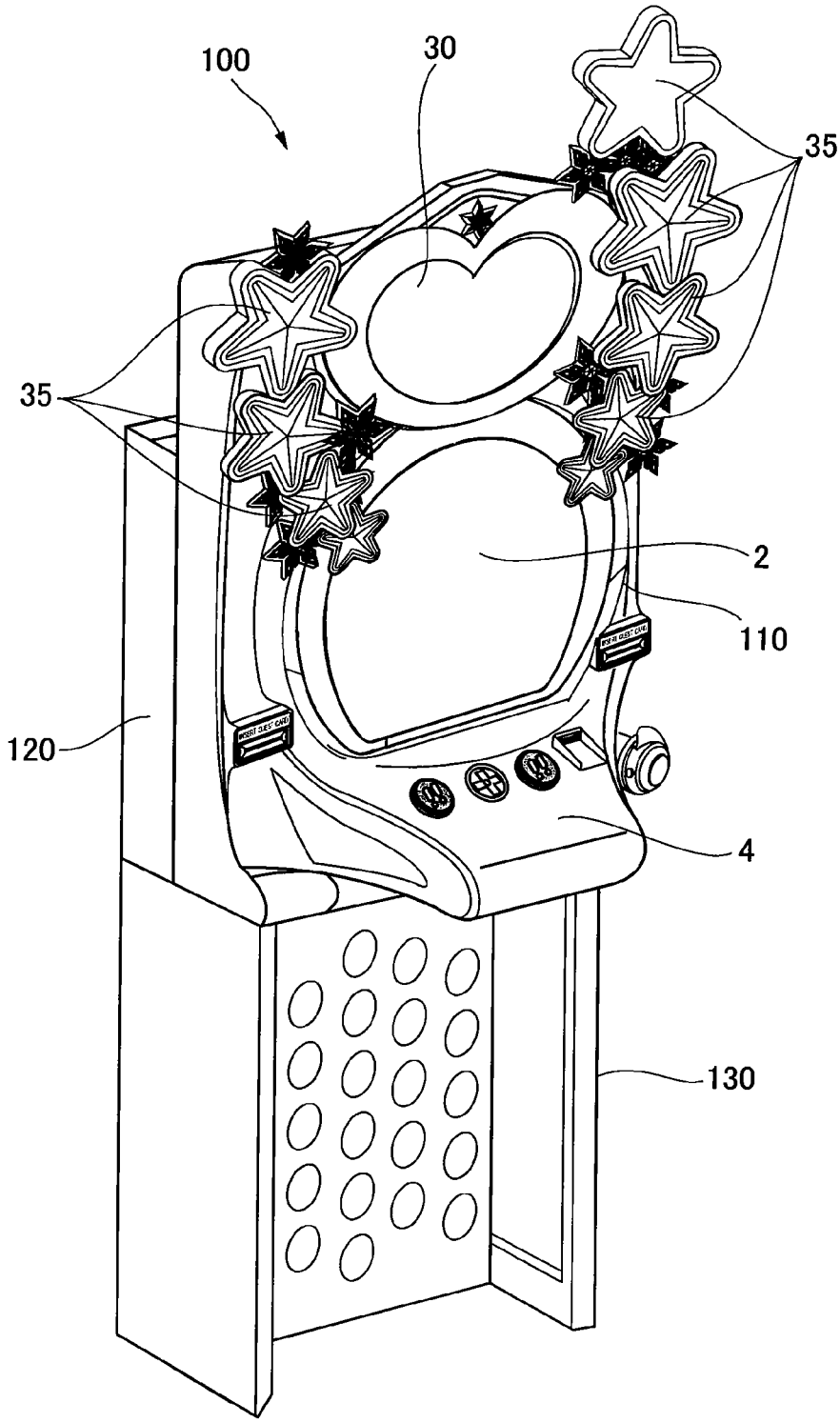
FIG. 2 is a perspective view showing the game machine.

First, the configuration of the whole game machine will be described in detail with reference to FIG. 1 and FIG. 2. FIG. 1 is a front view showing a game machine according to the present embodiment, and FIG. 2 is a perspective view showing the game machine.

A game machine 100 has a game board 2 provided with a playfield 6 in which playing balls 500 cascade downward. A glass frame 110 is provided on the front of the playfield 6 in the game board 2. An operation handle 3 for launching playing balls toward the playfield 6, is rotatably provided on the glass frame 110. An outer frame 120 is provided on the back surface of the glass frame 110, and the glass frame 110 and the outer frame 120 are supported by a support 130.

A tray unit 4 is formed on the glass frame 110. The tray unit 4 is provided with a paper money insert slit 21 to insert a predetermined amount of paper money (e.g. 1000 yen) as an inserted medium, a rate switching button 24 for changing the rate for a game (i.e. redenomination function), the settlement button 25 for settling the inserted money (or obtained credit) at the time of the end (stop) of the game, and a performance button 26 that can be operated in various performance conditions in progress of the game. In addition, the glass frame 110 is provided with a ticket payout slit 22 to pay out a ticket at the time of checkout, a card receiving slit 23 that can receive and eject a so-called house card such as a membership card and a guest card, which can be used in only the amusement place, a submonitor 30 and a plurality of decorative members 35 each shaped as a star.

When a predetermined amount of paper money (e.g. 1000 yen) is inserted in the paper money insert slit 21, launching operation is enabled to launch at least the predetermined number (for example, up to 1000) of playing balls in the game machine 100. In addition, the amount of paper money inserted is displayed on the submonitor 30 as credit. For example, when 1000 yen is inserted, "1000" is displayed as the credit of the player. Then, the credit decrements as "999, 998, . . . 700" every time a playing ball is launched. In addition, when the player wins a lottery for a bonus game started at the time a playing ball enters the start-up hole 9, a predetermined value of credit is provided and the credit value displayed on the submonitor 30 are added.

In other word, with the present embodiment, when the player wins a lottery (for a bonus game), playing balls are not paid out as prize balls (that is, the playing balls as a prize given to the player having won a lottery), but a game value corresponding to these prize balls is provided to the player as credit. As a result of this, the credit is accumulated, and therefore the number of playing balls allowed to be launched increases.

The submonitor 30 has a heart-like shape as shown in FIG. 1 and FIG. 2, and includes a liquid crystal display part 30*a* at the center. Then, this liquid crystal display part 30*a* serves as a data display that displays information on the above-described credit. The liquid crystal display part 30*a* also serves as a performance display part on which performance associated with a bonus game or a jackpot lottery is displayed or carried out.

A thicket paid out from the ticket payout slit 22 is a sheet-like ticket on which information on credit is recorded. The information includes an amount of money inserted and the value obtained by playing games, which the player holds until the time of checkout. Anti-counterfeit technology, including an identification number and a barcode, is applied to this ticket, and therefore it is possible to distinguish the ticket from a forged ticket. Here, a ticket is paid out by driving a ticket payout motor 202*a* provided in the game machine 100. This ticket payout motor 202*a* at least has two rollers (not shown) that sandwich a ticket. Then, each of these two rollers rotates to the ticket payout slit 22 side every time the ticket payout motor 202*a* rotates in a forward direction for one second, and one thicket is ejected from between the two rollers to the ticket payout slit 22.

Here, another configuration is possible where money information and credit information can be read and written by means of a house card inserted into the card receiving slit 23.

Next, each part of the game machine 100 will be described in detail with reference to FIG. 3 to FIG. 7.

Figure 3:
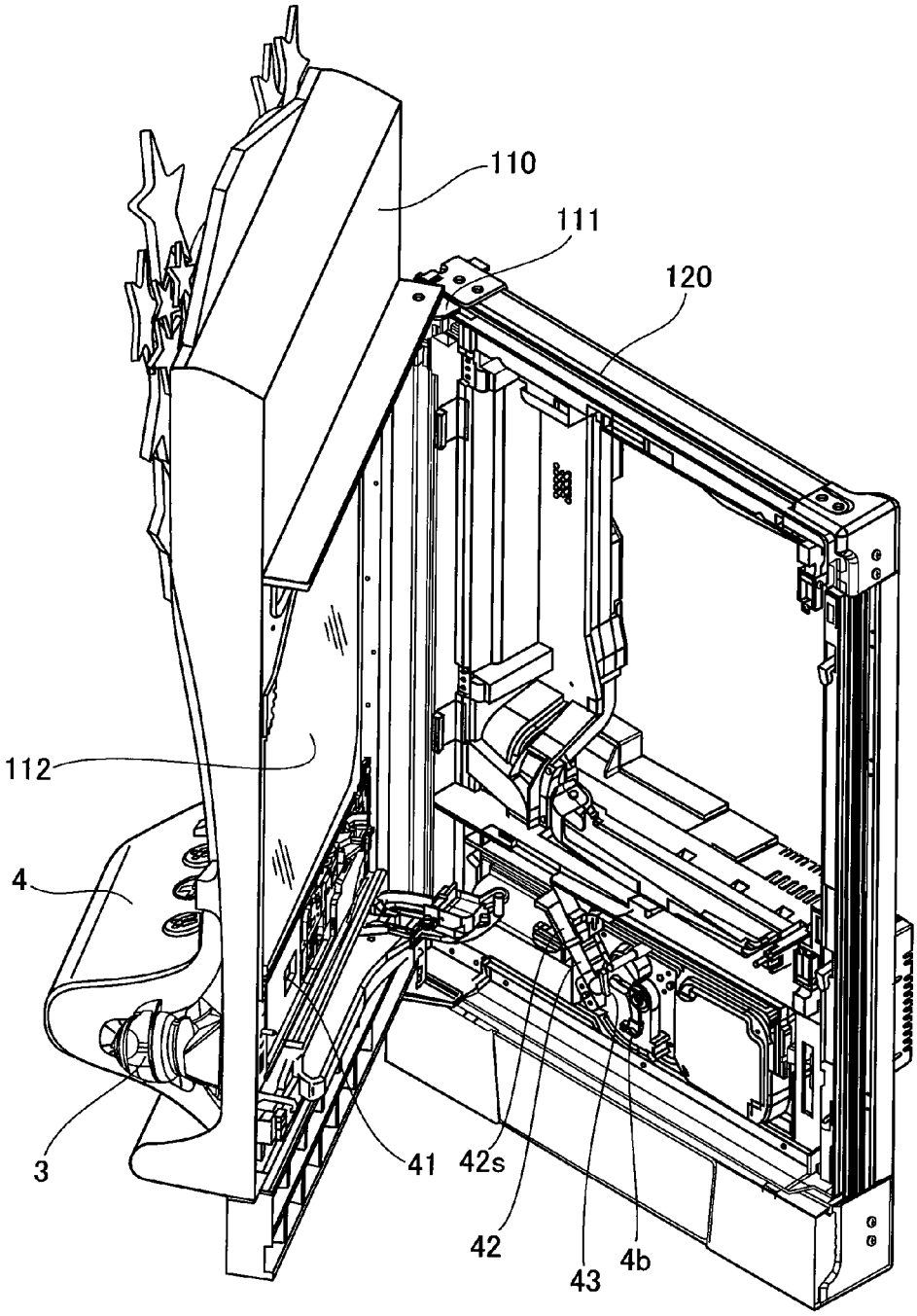
FIG. 3 is a perspective view showing a game machine in a state in which a glass frame is open.
Figure 4:
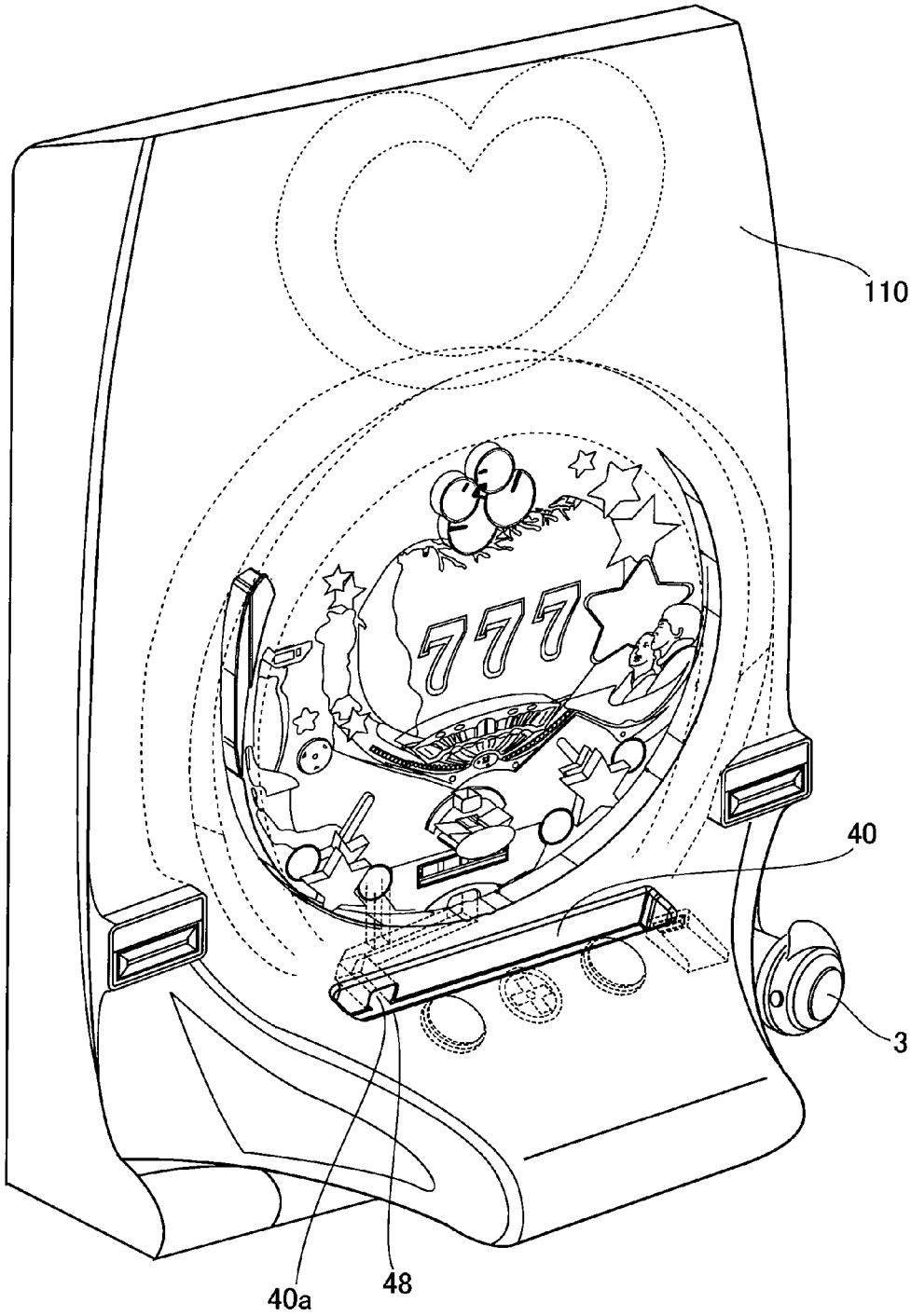
FIG. 4 is a perspective view showing the front of the glass frame.
Figure 5:
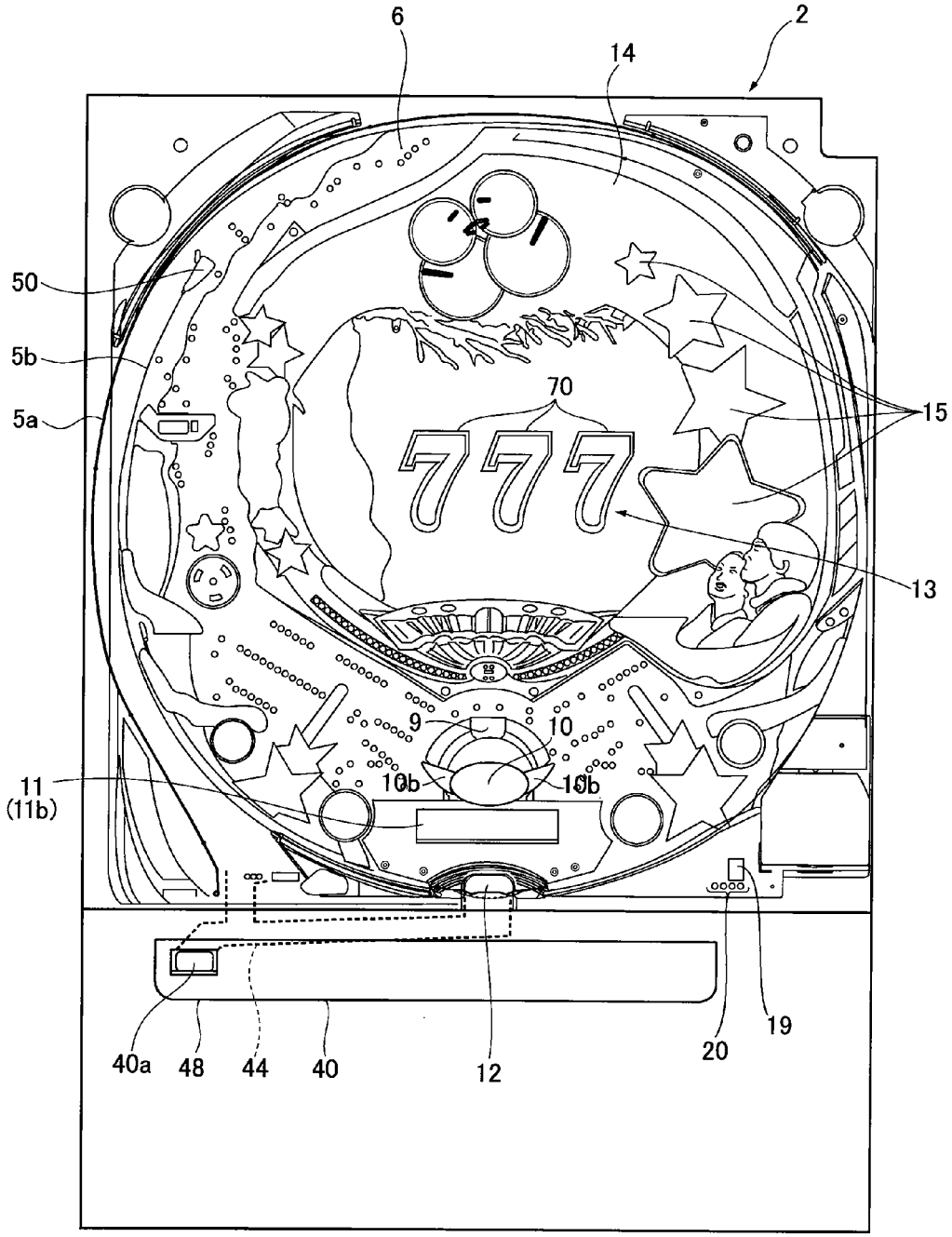
FIG. 5 is a front view showing a game board.
Figure 6:
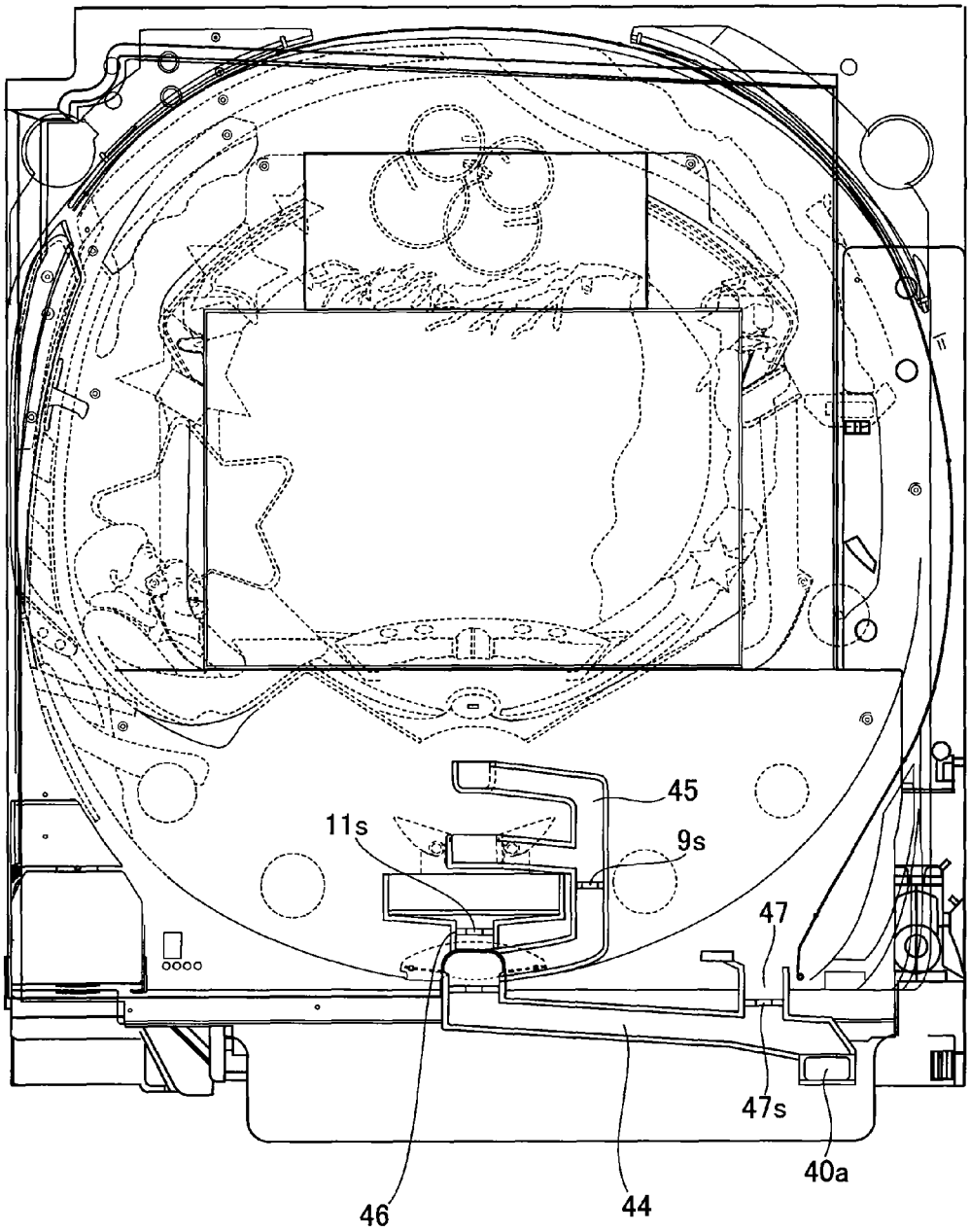
FIG. 6 is a back view showing the game board.
Figure 7:
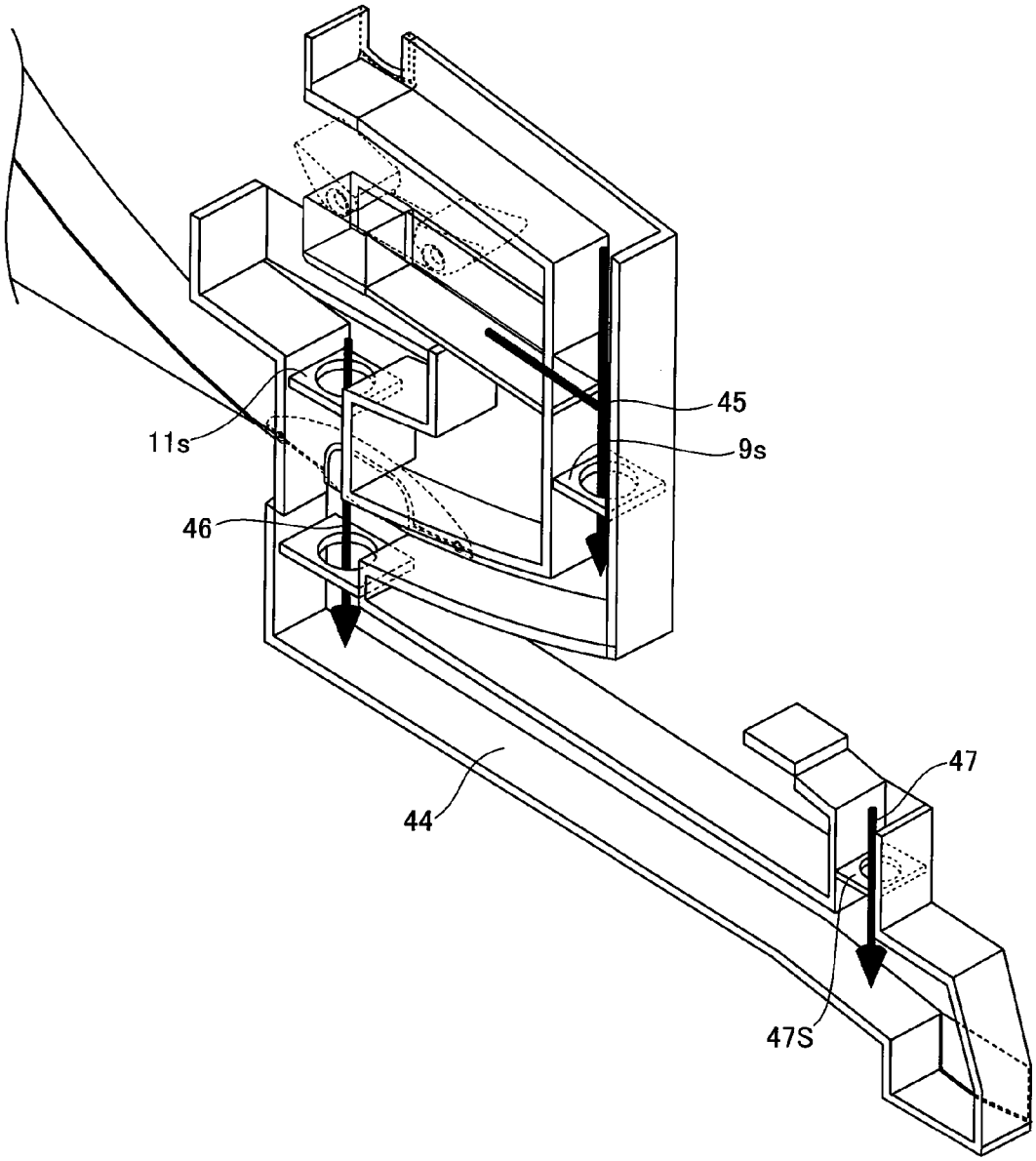
FIG. 7 is a partially enlarged view showing the back surface of the game board.

FIG. 3 is a perspective view showing the game machine 100 where the glass frame 110 is open. FIG. 4 is a perspective view showing the glass frame 110. FIG. 5 is a front view showing the game board 2, FIG. 6 is a back view (rear view) showing the game board 2, and FIG. 7 is a partially enlarged view showing the back surface of the game board 2.

The glass frame 110 supports a glass plate 112 that is located in front of a player and faces the game board 2 to transparently cover the playfield 6. Here, the glass plate 112 is detachably fixed to the glass frame 110.

In addition, the glass frame 110 is pivotably coupled to the outer frame 120 about a hinge mechanism part 111 at its one end in the horizontal direction (for example, the left side of the game machine 100), and the other end in the horizontal direction (the right side of the game machine 100) can open from the outer frame 120. The glass frame 100 with the glass plate 112 covers the game board 2 and pivotably coupled to the outer frame 120 about the hinge mechanism part 111 to swing as a door, so that it is possible to expose the interior portion of the outer frame 120 including the game board 2. A lock mechanism for fixing the other end of the glass frame 110 to the outer frame 120 is provided on the other end of the glass frame 110. The fixing with this lock mechanism can be released by a dedicated key. Moreover, the grass frame 110 has a door opening switch 33 (see FIG. 8) that detects whether or not the glass frame 110 is open.

In addition, the game machine 100 is provided with a tray 40 to accumulate a plurality of playing balls 500 and guide playing balls to a hammer 4*b* (see FIG. 3) for hitting playing balls. This tray 40 has a downslope toward the hammer 4*b* to convey playing balls to a launching rail 42 via a ball passing opening 41 provided on the back surface of the glass frame 110. This launching rail 42 also has a downslope toward the hammer 4*b*, and is provided with a stopper 43 for stopping playing balls in an upper part of the end of the downslope. Therefore, each playing ball 500 having passed through the ball passing opening 41 stays at the end of the launching rail 42 (see FIG. 3). In addition, a launched ball detection switch 42*s* is provided in launching rail 42 at the position through which a playing ball hit by the hammer 4*b* passes, and, when the launched ball detection switch 42*s* detects a playing ball, the detected playing ball is counted as a launched ball.

Then, when the player rotates the operation handle 3, a launching volume adjusting part 3*a* including a variable resistor directly connected to the operation handle 3 also rotates. Here, the hammer 4*b* is directly connected to the launching solenoid 4*c* including a rotary solenoid, and rotates by rotating the launching solenoid 4*c*. In a launching control circuit board 106, in order to launch a playing ball toward the playfield 6, the launching solenoid 4*c* is excited, and the playing ball 500 staying in the end of the launching rail 42 is hit by the hammer 4*b* at a launching strength according to the launching volume adjusting part 3*a*.

In this way, a playing ball launched from launched rail 42 rises between a rail 5*a* and a rail 5*b* shown in FIG. 5, goes over a ball return preventing part 5*c*, reaches the playing field 6, and then falls in the playing field 6. At this time, there are a plurality of pins and pinwheels in the direction the playing ball falls in the playfield 6, so that it is not possible to predict how the playing ball travels.

In addition, the start-up hole 9 that playing balls can enter is provided at a lower position in the playfield 6. A start-up hole detection switch 9*s* that detects a playing ball entering, is provided in the start-up hole 9, and, when this start-up hole detection switch 9*s* detects a playing ball entering, "a lottery for a bonus game" described later is held.

In addition, a tulip-like electrically movable start-up hole 10 (hereinafter "electrically movable start-up hole 10") is provided just below the start-up hole 9. The electrically movable start-up hole 10 has a pair of movable parts 10*b*, and is controlled to switch between a first state in which the pair of movable parts 10*b* is closed and a second state in which the pair of movable parts 10*b* is open. Here, when the electrically movable start-up hole 10 is controlled in the first state, it is not possible or it is difficult to receive a playing ball because the start-up hole 9 located just above the electrically movable start-up hole 10 lies in the way as an obstacle. On the other hand, when the electrically movable start-up hole 10 is controlled in the second state, the pair of movable parts 10*b* serves as a tray, and therefore a playing ball can easily enter the electrically movable start-up hole 10. In other words, when the electrically movable start-up hole 10 is in the first state, there is little chance that a playing ball enters the electrically movable start-up hole 10, and, on the other hand, when the electrically movable start-up hole 10 is in the second state, the chance that a playing ball enters the electrically movable start-up hole 10 increases. The above-described start-up hole detection switch 9*s* is also provided in the electrically movable start-up hole 10, and, when this start-up hole detection switch 9*s* detects a playing ball entering, "a lottery for a bonus game" is held as well. Here, the electrically movable start-up hole 10 serves as a start-up hole controlled to adjust variations and ununiformity in the number of playing balls entering in the start-up hole 9. In addition, both a playing ball entering the start-up hole 9 and a playing ball entering the electrically movable start-up hole 10 are detected by the same start-up detection switch 9*s*, and therefore, "the start-up hole 9" includes the electrically movable start-up hole 10 in the following descriptions.

Then, a bonus game gate 11 is provided further below the start-up hole 9. The bonus game gate 11 is usually kept closed by a bonus game gate opening and closing part 11*b* to prohibit playing balls from entering. By contrast with this, when a special game described later starts, the bonus game gate opening and closing part 11*b* opens and serves as a tray for guiding playing balls into the bonus game gate 11, so that playing balls can enter the bonus game gate 11. A bonus game gate detection switch 11*s* is provided in the bonus game gate 11, and, when the bonus game gate detection switch 11*s* detects a playing ball entering, a predetermined value of credit is provided. Here, in the present embodiment, the start-up hole 9 serves as a ball receiving hole, and the start-up hole detection switch 9*s* serves as a ball receiving hole detection part. In addition, the bonus game gate 11 serves as a special movable ball receiving hole, the bonus game gate detection switch 11*s* serves as a special bonus game gate detection part, and the bonus game gate opening and closing part 11*b* serves as a special movable bonus game gate device.

A discharge hole 12 for discharging playing balls which have failed to enter both the start-up hole 9 and the bonus game gate 11, is provided further below the bonus game gate 11, that is, in the bottom of the playfield 6.

In addition, a decorative member 14 that influences falling of playing balls is provided at the center of the game board 2. A performance display device 13 including a liquid crystal display (LCD), is provided at approximately the center of the decorative member 14, and a performance object device 15 including four star-shaped objects having different sizes, is provided on the right side of the performance display device 13. Here, although with the present embodiment, the performance display device 13, which is a liquid crystal display, is used as a display device, circular reels, a seven-segment LED display, a dot matrix display may be used.

This performance display device 13 displays images during a waiting period in which a game is not played, and images corresponding to the progress of a game. Particularly, three performance symbols 70 are arranged in a line to inform the result of a lottery for a bonus game described later, and, when these three performance symbols are stopped and displayed such that specific same performance symbols 70 are arranged (e.g. 777), it is informed that the result of the lottery is win. To be more specific, when a playing ball enters the start-up hole 9, each of the three performance symbols 70 is scrolled and displayed, and, after a predetermined period of time has passed, the performance symbols 70 are stopped and displayed. Here, the game machine 100 may be configured to give a great expectation to win a lottery for a bonus game, to the player by displaying various images, characters and so forth while the performance symbols 70 are variably displayed. In addition, in the present embodiment, the performance display device 13 serves as a variable display part.

The above-described performance object device 15 gives an expectation to the player by their actions. The performance object device 15 can make any of the stars having different sizes illuminate, flash or swing, for example. The game machine 100 is configured to give various expectations to the player by the actions of the performance object device 15.

In addition, a performance button 26 that the player can push is provided on the tray unit 4. This performance button 26 is enabled, for example, when a massage to operate the performance button 26 is displayed on the performance display device 13. Here, a performance button detection switch 26*s* is provided on the performance button 26, and, when this performance button detection switch 26*s* detects operation of the player, additional performance is carried out in response to this operation. Here, the above-described rate switching button 24 and the settlement button 25 are buttons that the player can push like the performance button 26. A rate switching button detection switch 24*s* and the settlement button detection switch 25*s* are provided on the rate switching button 24 and the settlement button 15, respectively and can detect the player operating the buttons.

Moreover, the game machine 100 has an audio output device 18 (see FIG. 8 described later) including a speaker to carry out audio performance in addition to the performance by the above-described performance devices.

Then, a special symbol display device 19 and a special symbol reservation display 20 are provided in the lower right corner of the playfield 6.

Moreover, even if a playing ball enters the start-up hole 9 while the special symbols are being variably displayed or a special game (described later) is played, when a lottery for a bonus game cannot be held immediately, the right of the bonus game is reserved under a specific condition. To be more specific, the random number for determining a special symbol obtained at the time a playing ball enters the start-up hole 9, is stored to reserve the right. The maximum number of balls to be reserved is set 4, and this number is displayed on the special symbol reservation display 20. Here, when one ball is reserved, one LED of the special symbol reservation display 20 is turned on, and, when two balls are reserved, two LEDs in the special symbol reservation display 20 are turned on. In addition, when three balls are reserved, three LEDs in the special symbol reservation display 20 are turned on, and, when four balls are reserved, four LEDs in the special symbol reservation display 20 are turned on.

Moreover, a discharge hole guidepath 44 that guides a playing ball entering the discharge hole 12 to the tray 40 (specifically, a receiving hole 40*a* provided as an inlet of the tray 40) is provided on the back surface of the game board 2. This discharge guidepath 44 is formed as a passageway connecting the discharge hole 12 and the receiving hole 40*a*, and allows playing balls to roll through this passageway. In addition, the discharge guidepath 44 has a downslope from the discharge hole 12 to the receiving hole 40*a*, and the playing balls guided from the discharge hole 12 to the discharge hole guidepath 44 go down and roll toward the receiving hole 40*a* through the discharge hole guidepath 44. This "downslope" has an enough inclining angle to prevent playing balls guided from the discharge hole 12 to the discharge hole guidepath 44 from flowing back to the discharge hole 12. If a playing ball launched through the tray 40 enters the discharge hole 12, the playing ball returns to the tray 40 through the discharge guidepath 44.

In addition, as shown in FIG. 6 and FIG. 7, the game board 2 is provided with a received ball guidepath 45 that guides a playing ball entering in the start-up hole 9 to the discharge hole guidepath 44, and a bonus game ball guidepath 46 that guides a playing ball entering the bonus game gate 11 to the discharge hole guidepath 44, on the back surface. Moreover, playing balls which have failed to arrive at the playfield 6 because the playing balls are launched with a low launching strength (that is, playing balls which have failed to go over the ball return preventing part 5*c*) are regarded as foul balls, and join in the discharge hole guidepath 44 from a foul ball passageway 47. Accordingly, the playing balls launched via the tray 40 all return to the tray 40 and the playing balls circulate in the game machine 100. Here, the start-up hole detection switch 9*s* is provided in the received ball guidepath 45, and the bonus game gate detection switch 11*s* is provided in the bonus game ball guidepath 46. Moreover, a foul ball detection switch 47*s* is provided in the foul ball passageway 47 as well, and, when this foul ball detection switch 47*s* detects a playing ball, the playing ball is counted as a foul ball.

Then, cover part 48 (see FIG. 4 and FIG. 5) that covers the tray 40 to prevent the playing balls in the tray 40 from being taken out, is provided over the tray 40. This cover part 48 is made of a transparent plate and allows the player to visually check if playing balls are accumulated in the tray 40. In this way, according to the present embodiment, the tray 40 is covered with the cover part 48, and therefore the launched playing balls cannot be taken out even if the playing balls return to the tray 40. Therefore, with the present embodiment, it is possible to play games using only the predetermined number of playing balls enclosed in the game machine 100. Here, a requirement of "the predetermined number" is to allow the player to always launch playing balls, that is, it is preferred that playing balls have always been supplied at least in the tray 40 when playing balls are launched. In addition, it is preferred that accumulated playing balls still remain in the tray 40 even if a plurality (e.g. 10 to 20) of playing balls cannot return to the tray 40 due to clogging.

Moreover, a main control circuit board 101, a performance control circuit board 102, a frame control circuit board 103, a power circuit board 107, a game information output terminal board 108 and so forth, are provided on the back surface of the game machine 100. In addition, a power plug 50 and a power switch (not shown) which are used to supply power to the game machine 100, are provided on the power circuit board 107.

(The Internal Configuration of a Control Part)

Figure 8:
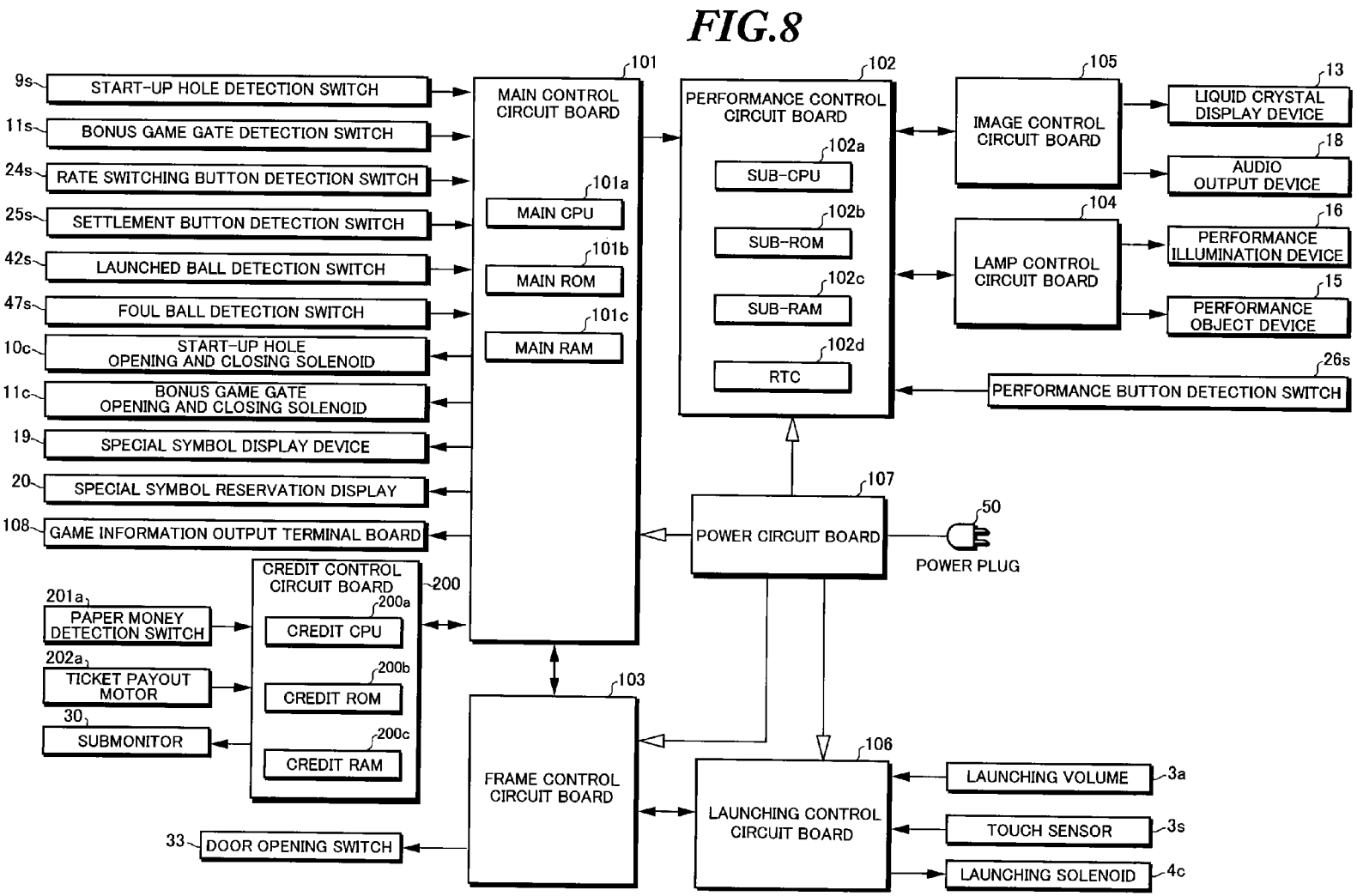
FIG. 8 is a block diagram showing the configuration of the game machine.

Next, a control part for controlling the progress of a game will be described with reference to the block diagram of FIG. 8 showing the game machine 100.

The main control circuit board 101 is a main control part to control basic actions of a game. The main control circuit board 101 controls a game by receiving various detection signals from the start-up detection switch 9*s* and so forth and operating the special symbol display device 19, a bonus game gate opening and closing solenoid 11*c* and so forth, while controlling signal input/output between the credit control circuit board 200 and the main control circuit board 101. Here, in the present embodiment, the main control circuit 101 serves as a lottery part, the game value providing part, a special lottery part, and a right of the lottery providing part. In addition, the main control circuit 101 corresponds to an example of the variable display control part and an example of the performance execution part.

This main control circuit board 101 has a main CPU 101*a*, a main ROM 101*b*, a main RAM 101*c*, main control input ports and main control output ports (not shown).

The main control input ports are connected to the credit control circuit board 200, the frame control circuit board 103, the start-up hole detection switch 9*s* that detects a playing ball entering the start-up hole 9, the bonus game gate detection switch 11*s* that detects a playing ball entering the bonus game gate 11, the rate switching button detection switch 24*s*, the settlement button detection switch 25*s*, the launched ball detection switch 42*s* and foul ball detection switch 47*s*. Various signals are inputted to the main control circuit board 101 through the main control input ports.

Meanwhile, the main control output ports are connected to a start-up hole opening and closing solenoid 10*c* that opens and closes the pair of movable parts 10*b* in the electrically movable start-up hole 10, the bonus game gate opening and closing solenoid 11*c* that opens and closes the bonus game gate opening and closing part 11*b*, the special symbol display device 19 that displays special symbols, the special symbol reservation display 20 that displays the number of playing balls reserved for special symbols, and the game information output terminal board 108 that outputs external information signals. Various signals are outputted through the main control output ports.

The main CPU 101*a* reads a program stored in the main ROM 101*b* and performs arithmetic processing based on the input signals from each detection switch and a timer, and directly controls each device and display, or transmits commands to other circuit boards according to the result of the arithmetic processing. In addition, when a predetermined amount of paper money (e.g. 1000 yen) is inserted in the paper money insert slit 21, the main CPU 101*a* outputs a launch enabling signal to enable the launch control circuit board 106 to launch playing balls through the frame control circuit board 103 until at least the predetermined number of playing balls (e.g. 1000) has been launched.

The main ROM 101*b* stores the program for game control, and various data and tables required for playing a game. The main ROM 101*b* stores, for example, a bonus game determination table (see FIG. 9) referred at the time of a lottery for a bonus game to determine whether or not to win a bonus game, and a symbol determination table (see FIG. 10) that determines the special symbol to be stopped. A specific example of each table will be described later with reference to FIG. 9 and FIG. 10. Here, the above-described tables are characteristic tables as merely examples among tables according to the present embodiment, and many other tables and programs (not shown) are provided in progress of a game.

The main RAM 101*c* serves as a work area for data at the time the main CPU 101*a* performs arithmetic processing. The main RAM 101*c* has, for example a special symbol reservation count (U) storage area, a determination storage area, special symbol storage area, a round game count (R) storage area, a bonus game ball counter (C) storage area, a stopped symbol data storage area, a performance transmission data storage area, a special symbol time counter, a special game timer counter, and a special electrically movable device control processing data storage area. Here, the above-described storage areas are merely examples, and many other storage areas may be provided. With the present embodiment, the main RAM 101*c* which stores a first special symbol storage area and a second special symbol storage area serves as a reservation storage area.

The game information output terminal board 108 is a circuit board to output external information signals generated in the main control circuit board 101 to a control device (e.g. a control server and a pachinko parlor-dedicated computer) in an amusement place. The game information output terminal board 108 is connected to the main control circuit board 101 by wiring, and has a connector to connect external information to the control device and so forth in an amusement place.

The power circuit board 107 has a backup power supply including a capacitor, supplies a power supply voltage to the game machine 100, monitors the power supply voltage supplied to the game machine 100 and outputs a power interruption detection signal to the main control circuit board 101 when the power supply voltage is equal to or lower than a predetermined value. To be more specific, a power interruption detection signal is in the high level, the main CPU 101*a* can operate, and, on the other hand, when a power interruption detection signal is in the low level, the main CPU 101*a* stops operating. A backup power supply is not limited to a capacitor, but a battery is possible, and a combination of a capacitor and a battery is also possible.

The performance control circuit board 102 mainly controls each performance during play of a game or in a waiting time. This performance control circuit board 102 has a sub-CPU 102*a*, a sub-ROM 102*b* and a sub-RAM 102*c*, and is connected to the main control circuit board 101 to enable simplex communication from the main control circuit board 101 to the performance control circuit board 102. The sub-CPU 102*a* reads the program stored in the sub-ROM 102*b* and performs arithmetic processing based on a command transmitted from the main control circuit board 101 or the input signals from the performance button detection switch 26*s* and the timer, and transmits corresponding data to a lamp control circuit board 104 or an image control circuit board 105. The sub-RAM 102*c* serves as a work area for data at the time the sub-CPU 102*a* performs arithmetic processing. Here, in the present embodiment, the performance control circuit board 102 serves as the variable display control part and corresponds to an example of the performance execution part.

The sub-ROM 102*b* in the performance control circuit board 102 stores the program for performance control, and various data and tables required for playing a game. To be more specific, the sub-ROM 102 stores a performance pattern determination table to determine a performance pattern based on a variation pattern specifying command received from the main control circuit board, a performance symbol determination table (see FIG. 11) to determine a combination of performance symbols 70 to be stopped and displayed. Here, the above-described tables are characteristic tables as merely examples among tables according to the present embodiment, and many other tables and programs (not shown) are provided in progress of a game.

The sub-RAM 102*c* in the performance control circuit board 102 serves as a work area for data at the time the sub-CPU 102*a* performs arithmetic processing and has a plurality of storage areas. To be more specific, a command receiving buffer, a performance pattern storage region, a performance symbol storage area and so forth, are provided on the sub RAM 102*c*. Here the above-described storage areas are merely examples as well, and many other storage area may be provided.

The frame control circuit board 103 performs error detection and controls communication between the main control circuit board 101 and the launch control circuit board. This frame control circuit board 103 has a payout CPU, a payout ROM and a payout RAM (not shown), and is connected to the main control circuit board 101 to enable duplex communication with the main control circuit board 101. The payout CPU reads a program stored in the payout ROM and performs arithmetic processing, based on the input signals from the door opening and closing switch 33 and the timer, and transmits corresponding data to the main control circuit board 101 based on the arithmetic processing. At this time, the payout RAM serves as a work area for data at the time the payout CPU performs arithmetic processing. In addition, upon receiving a launch enabling signal from the main control circuit board 101, the payout RAM outputs the inputted launch enabling signal to the launch control circuit board 106.

The lamp control circuit board 104 controls lightning of a performance illumination device 16 provided on the game board 2 and controls driving of a motor to change the direction to emit light. In addition, the lamp control circuit board 104 controls electric conduction of a driving source such as a solenoid or a motor that activates the performance object device 15. This lamp control circuit board 104 is connected to the performance control circuit board 102 and performs the above-described various kinds of control, based on data transmitted from the performance control circuit board 102.

The image control circuit board 105 has an image CPU, an image ROM, an image RAM and a VRAM (not shown) to control image display of the performance display device 13, and also has an audio CPU, an audio ROM and an audio RAM. The image control circuit board 105 is connected to the performance control circuit board 102 to enable duplex communication with the performance control circuit board 102, and connected with the performance display device 13 and the audio output device 18 at the output side.

The image ROM stores a large number of performance symbols 70 and image data on background images and so forth to be displayed on the performance display device 13. The image CPU reads a predetermined program based on a command transmitted from the performance control circuit board 102. The image CPU also reads predetermined image data from the image ROM into a VRAM to control display of the performance display device 13. The image CPU performs various types of image processing, such as background image display processing, performance symbol display processing, and character image display processing, on the performance display device 13. A background image, a performance symbol image and a character image are superimposed and displayed on the display screen of the performance display device 13. In other words, the performance symbol image and the character image are displayed in such a manner as to be shown at a less depth than the background image when viewed from the front. In this case, if the background image and the symbol image overlap one another in the same position, a known hidden surface removal technique such as a z-buffer algorism is used to refer to a z value in the z-buffer for each image in the image data in order to preferentially store the symbol image in the VRAM.

In addition, the audio ROM stores a large amount of audio data outputted from the audio output device 18. The audio CPU reads a predetermined program based on a command transmitted from the performance control circuit board 102 and controls audio output of the audio output device 18.

The credit control circuit board 200 controls communication with the main control circuit board 101 related to progress of a game including the start time of the game, the end time of the game and so forth. Upon receiving a predetermined amount of money (e.g. 1000 yen, 100 HKD and 100 USD) as an inserted medium which is inserted from the paper money insert slot 21, the credit control circuit board 200 outputs a game enabling signal to enable play of a game until a predetermined number of playing balls (for example, 1000, or, if the rate is changed, 500 or 100) have been launched. In addition, the credit control circuit board 200 pays out a ticket by driving the ticket payout motor 202*a*, and displays credit information on the submonitor 30. With the present embodiment, the ticket control circuit board 200 serves as a reception control part.

In addition, the credit control circuit board 200 has a credit CPU 200*a*, a credit ROM 200*b*, a credit RAM 200*c*, and credit control input/output ports (not shown). Then, the credit control input/output ports are connected to the main control circuit board 101, a paper money detection switch 201*s*, the ticket payout motor 202*a* and the sub-monitor 30. The credit control input/output ports allow a paper money insert signal outputted from the paper money detection switch 201*s*, and a settlement signal and a bonus game signal outputted from the main control circuit board 101 to be inputted, and also allow a game enabling signal to be outputted to the main control circuit board 101. This game enabling signal contains the credit information at the time paper money is inserted.

Upon detecting a predetermined amount of paper money (e.g. 1000 yen) being inserted into the paper money insert slit 21, the paper money detection switch 201*s* outputs a paper money insert signal to the credit CPU 200*a* via the credit control input/output port. Here, in the present embodiment, the credit corresponds to an example of the game values (a first game value and a third game value).

Upon receiving driving data outputted from the credit CPU 200*a* via the credit control input/output port, the ticket payout motor 202*a* drives a motor.

The credit CPU 200*a* reads a program stored in the credit ROM 200*b* and performs arithmetic processing, based on the inputted various signals, and controls output of the various signals.

The credit ROM 200*b* stores a program for paper money insert control, and various data and tables required for arithmetic processing.

The credit RAM 200*c* serves as a work area for data at the time the credit CPU 200*a* performs arithmetic processing, and has a plurality of storage areas. For example, a credit data storage area to store data for credit information (credit data) is provided in the credit RAM 200*c*. This credit data storage area stores the credit of the player, which increases and decrease in progress of a game and is updated at an appropriate time. With the present embodiment, the credit counter serves as a reception information storage part, and the ticket CPU 200*a* which makes the credit counter store the data serves as a storage command part. In addition, a PAYOUT counter and a BONUS counter in the ticket RAM 200*c* serve as a one-round play privilege count storage part and a MAXPAYOUT counter and a MAXBONUS counter serve as a maximum privilege count storage part.

In addition, the credit CPU 200*a* commands the submonitor 30 to display information based on the credit data stored in the credit RAM 200*c*. By this means, the value of the credit that the player has acquired, is displayed on the submonitor 30.

Upon receiving a launch enabling signal from the frame control circuit board 103, the launch control circuit board 106 enables launching of playing balls. Then, the launch control circuit board 106 reads a touch signal from a touch sensor 3*s* and a voltage value from the launching volume adjusting part 3*a* and controls electric conduction of the launching solenoid 4*c* to launch a playing ball. Here, the rotating speed of the launching solenoid 4*c* is set 99 times per second, according to the frequency based on the output period of a crystal oscillator provided in the launch control circuit board 106. By this means, the number of launched playing balls per minute is 99 because one playing ball is launched every time the launching solenoid 4*c* rotates once. That is, a playing ball is launched per about 606 milliseconds.

(Various Tables)

Next, various tables stored in the main ROM 101*b* will be described in detail with reference to FIG. 9 and FIG. 10. After that, various tables stored in the sub-ROM 102*b* will be described in detail with reference to FIG. 11.

(Bonus Game Determination Table)

FIG. 9 shows a bonus game determination table referred to determine whether or not to win a bonus game in "a lottery for a bonus game".

Referring to this bonus game determination table, the main CPU 101*a* determines whether the result of the lottery for a bonus game is "win" "small win" or "loss", based on the obtained random number for determining a special symbol. In this table, three random numbers for determining a special symbol, "7", "33" and "77" are determined as "win", and 600 random numbers for determining a special symbol, "100" to "699" are determined as "small win". The other 397 random numbers for determining a special symbol is determined as "loss". Therefore, the probability of determining as "win" is 1/333.3 because the range of the random numbers for determining a special symbol is 0 to 999.

(Symbol Determination Table)

FIG. 10 shows a symbol determination table to determine the special symbol to be stopped. FIG. 10A shows a symbol determination table for win to determine the symbol to be stopped; FIG. 10B shows a symbol determination table to for small win determine the symbol to be stopped; and FIG. 100 shows a symbol determination table for loss to determine the symbol to be stopped.

When a win is determined, the main CPU 101*a* refers to the symbol determination table shown in FIG. 10A and determines the kind of a special symbol (data for the symbol to be stopped) based on the acquired random number for a bonus game. For example, according to the symbol determination table shown in FIG. 10A, the main CPU 101*a* determines "01" (special symbol 1) as data for the symbol to be stopped when the random numbers for a bonus game symbol are "0" to "32", and, when the random numbers for a bonus game symbol are "33" to "99", determines "02" (special symbol 2) as data for the symbol to be stopped.

In addition, a small win is determined, the main CPU 101*a* refers to the symbol determination table shown in FIG. 10B and determines "03" (special symbol A) as data for the symbol to be stopped when the random numbers for a small win symbol are "0" to "4", and, when the random numbers for a small win symbol are "50" to "99", the main CPU 101*a* determines "06" (special symbol D) as data for the symbol to be stopped.

Moreover, when a loss is determined, the main CPU 101*a* refers to the symbol determination table shown in FIG. 10C and determines "00" (special symbol 0) as data for the symbol to be stopped.

Then, at the time special symbols start being variably displayed, the main CPU 101*a* creates a performance symbol specifying command as special symbol information, based on the kind of the determined special symbol (data for the symbol to be stopped). Here, a performance symbol specifying command is formed by data of 2 bytes, and includes MODE data of 1 byte for identifying the category of a control command and DATA data of 1 byte representing the content (function) of the executed control command. The same applies to a variation pattern specifying command and so forth described later.

(Performance Symbol Determination Table)

FIG. 11A shows a performance symbol determination table for win to determine a combination of the performance symbols 70 to be stopped and displayed when a win is determined. FIG. 11B shows a performance symbol determination table for small win to determine a combination of the performance symbols 70 to be stopped and displayed when a small win is determined.

When win is determined, the sub-CPU 102*a* refers to the performance symbol determination table for win shown in FIG. 11A, and determines performance symbol data based on a received performance symbol designating command. Meanwhile, when small win is determined, the sub-CPU 102*a* refers to the performance symbol determination table for small win shown in FIG. 11B, and determines performance symbol data based on a received performance designating symbol command. For example, as seen from the performance symbol determination table for win shown in FIG. 11A, when performance symbol specifying command "E0H01H" representing special symbol 1 is received, a combination of three same performance symbols "7 7 7" is determined, and, when performance symbol designating command "E0H02H" representing special symbol 2 is received, a combination of three same performance symbols "3 3 3" is determined. Likewise, in a case of small win, when performance symbol designating command "E0H03H" representing special symbol A is received, a combination of three same performance symbols "2 2 2" is determined, and, when performance symbol designating command "E0H04H" representing special symbol B is received, a combination of three same performance symbols "6 6 6" is determined. In addition, when performance symbol designating command "E0H05H" representing special symbol C is received, a combination of three same performance symbols "8 8 8" is determined. Here, when performance symbol designating command "E0H06H" representing special symbol D, a combination of three performance symbols including one "4" is determined.

(Descriptions of the Kinds of a Bonus Game)

With the present embodiment, "win" means that a right to play a bonus game is acquired by winning a lottery for a bonus game held on condition that a playing ball enters the start-up hole 9. In a "bonus game", 15 times of round games are played, where the bonus game gate 11 is open. The maximum period of time over which the bonus game gate 11 is open for a total of round games, is set 29.5 seconds, and, if a predetermined number of playing balls (e.g. 10) enter the bonus game gate 11 within that period of time, one round game ends. Then, if a playing ball enters the bonus game gate 11, so that a predetermined value of credit is provided. That is, a "bonus game" can greatly increase credit because a predetermined value of credit is provided every time a playing ball enters the bonus game gate 11.

With the present embodiment, as shown in FIG. 10A, the value of credit provided in the bonus game associated with special symbol 1 is "6000", and the value of credit provided in the bonus game associated with special symbol 2 is "3000". This is the total value of the credit provided in one bonus game, and practically, the credit is not provided at a time but a small portion of the credit is provided several times. In this way, a plurality of small portions of credit are provided (a small portion of the credit is provided several times), it is possible to provide credit every time a playing ball enters the bonus game gate 11, or make the player feel as if the value of credit is incremented every time a playing ball enters the bonus game gate 11.

Meanwhile, "small win" means that a right to obtain credit is provided by getting a small win in a lottery for a bonus game held on condition that a playing ball enters the start-up hole 9. To be more specific, in a "small win", the bonus game gate 11 does not open and a predetermined value of credit is provided (at a time) when a combination of performance symbols 70 corresponding to small win (see FIG. 11) is displayed.

With the present embodiment, as shown in FIG. 10B, the values of credit provided in a small win are "5" to "500", which are significantly smaller than a bonus game. Therefore, the credit is provided to the player at a time because it is not beneficial for the player to provide a small portion of credit several times.

Next, progress of a game in the game machine 100 will be explained using a flowchart.

(Main Processing in the Main Control Circuit Board)

Figure 12:
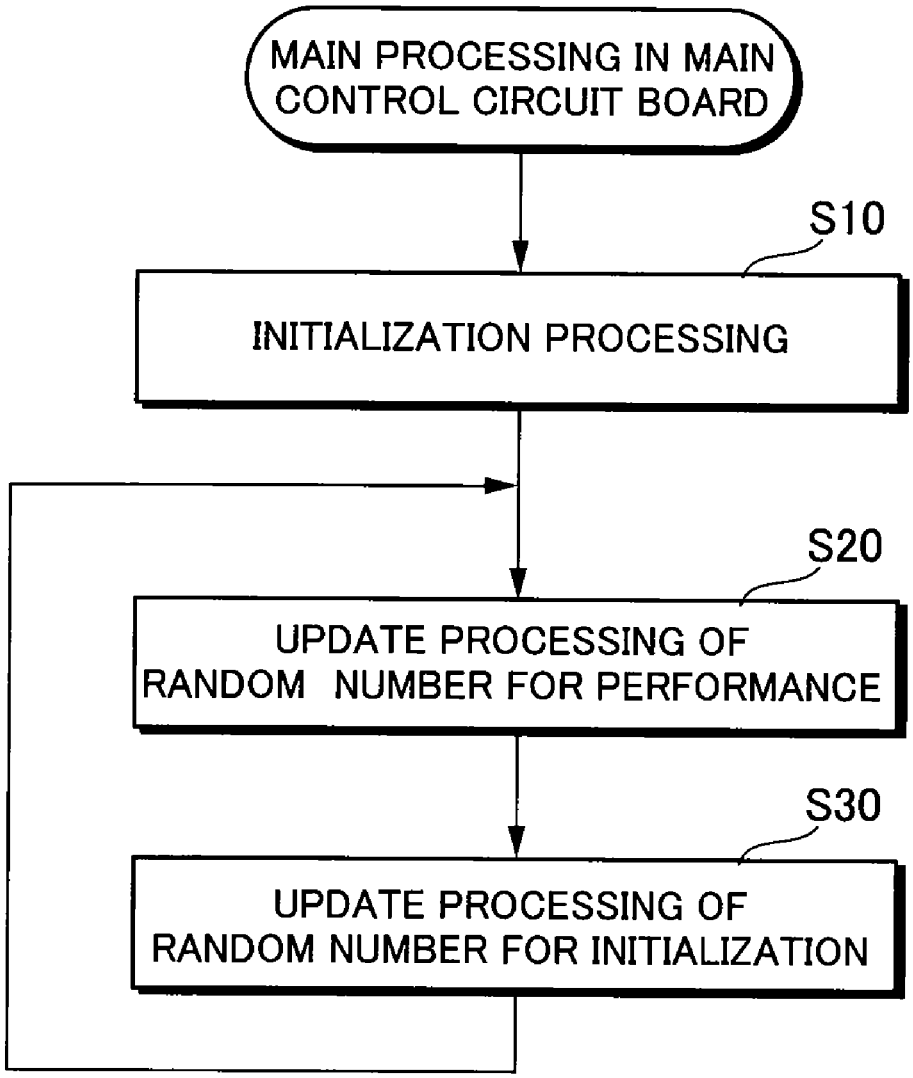
FIG. 12 shows main processing in a main control circuit board.

Now, main processing in the main control circuit board 101 will be explained with reference to FIG. 12.

When the power circuit board 107 supplies power, the main CPU 101*a* resets the system and performs the following main processing.

First, the main CPU 101*a* performs initialization processing in step S10. In this processing, the main CPU 101*a* reads a boot program from the main ROM in response to turn-on of the power supply and performs processing to initialize flags stored in the main RAM.

In step S20, the main CPU 101*a* performs processing to update a random number for performance used to determine a variation mode (variation period of time) of special symbols.

In step S30, the main CPU 101*a* updates an initial random number for determining a special symbol and an initial random number for a bonus game symbol. After that, the processing in the step S 20 and the processing in the step S30 are repeatedly performed until a predetermined interrupt processing is performed.

(Timer Interrupt Processing in the Main Control Circuit Board)

Figure 13:
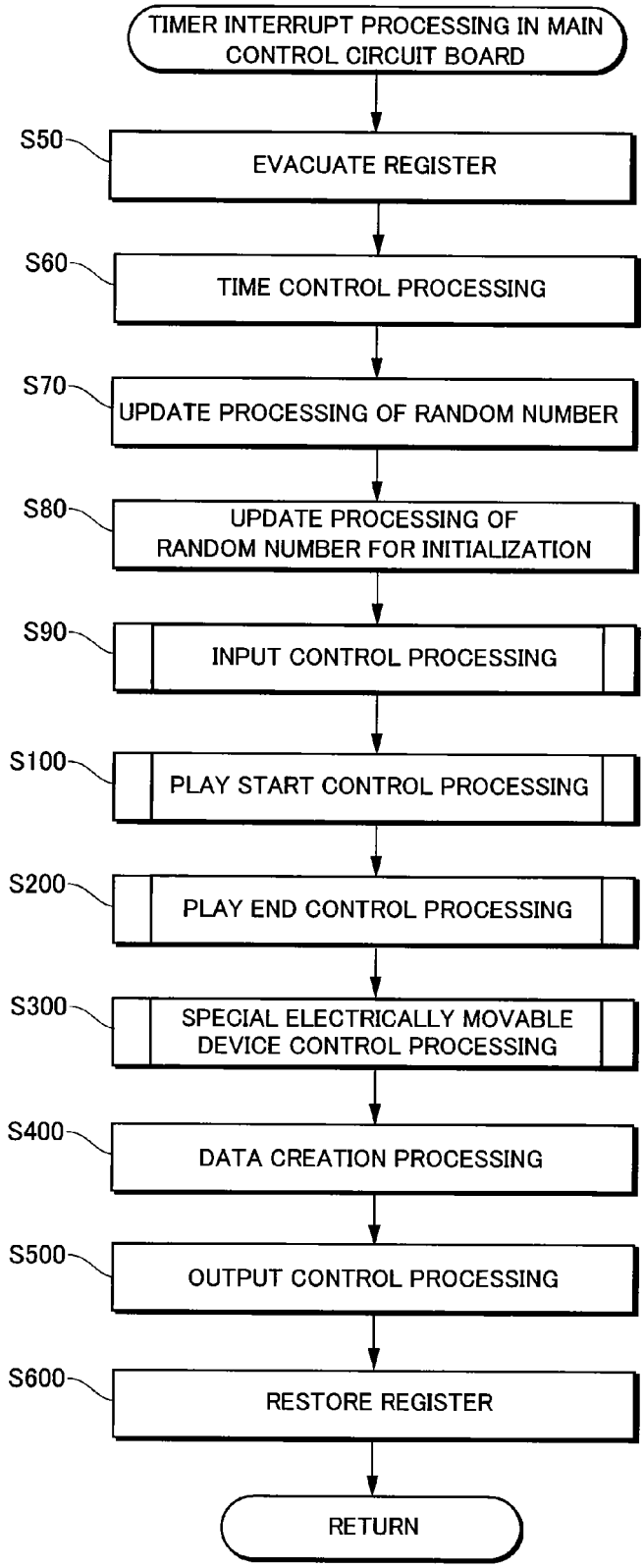
FIG. 13 shows timer interrupt processing in the main control circuit board.

Timer interrupt control processing in the main control circuit board 101 will be described with reference to FIG. 13.

A clock pulse generation circuit for resetting, which is provided in the main control circuit board 101, generates a clock pulse per predetermined period (4 milliseconds) to perform timer interrupt processing described later.

First, in step S50, the main CPU 101*a* evacuates information stored in a register in the main CPU 101*a* to a stack region.

In step S60, the main CPU 101*a* performs time control processing to update various timer counters, such as update processing of a special symbol time counter and update processing of a special game timer counter to measure a period of time for which a special electrically movable device is open.

In step S70, the main CPU 101*a* performs processing to update random numbers, such as a random number for determining a special symbol and a random number for a bonus game symbol. To be more specific, each of the random numbers and each of the random number counters are updated by being incremented by "1". When the random number counter incremented by 1 exceeds the maximum value in the random number range (that is, when going the full circle of the random number counter), the random number counter is reset to zero, and the random number is newly updated from the initial random number at that time.

In step S80, the main CPU 101*a* updates initial random numbers for determining a special symbol and a bonus game symbol.

In step S90, the main CPU 101*a* performs input control processing. In this processing, the main CPU 101*a* performs input processing to determine whether or not the main CPU 101*a* has received signals, as input, from the start-up hole detection switch 9*s*, the bonus game gate detection switch 11*s*, the rate switching button detection switch 24*s*, the launched ball detection switch 42*s* and the foul ball detection switch 47*s*. To be more specific, when receiving a detection signal from the start-up detection switch 9*s*, the main CPU 101*a* obtains a random number for determining a special symbol, a random number for a bonus game symbol and a random number for performance, and stores the obtained random numbers in the special symbol storage area. Meanwhile, when receiving various detection signals from the bonus game gate detection switch 11*s*, the main CPU 101*a* adds a predetermined value of credit to update the credit. When receiving a detection signal from the rate switching button detection switch 24*s*, the main CPU 101*a* changes the current set rate. When receiving a detection signal from the launched ball detection switch 42*s*, the main CPU 101*a* subtracts the number of balls allowed to be launched (KY), and, when receiving a detection signal from the foul ball detection switch 47*s*, adds the number of balls allowed to be launched (KY). If a detection signal has not been inputted from the launched ball detection switch 42*s* just before, the main CPU 101*a* does not add the number of balls allowed to be launched (KY) even if receiving a detection signal from the foul ball detection switch 47*s*, and therefore can prevent incorrect processing including unconsidered adding, or incorrect operation.

In step S100, when receiving a game enabling signal from the credit control circuit board 200, the main CPU 101*a* performs play start control processing to set predetermined data for starting a permitted game (i.e. a game permitted to launch a predetermined range of number of playing balls). This play start control processing will be described in detail with reference to FIG. 17.

In step S200, the main CPU 101*a* performs play end control processing to set predetermined data for ending the permitted game. This paly end control processing will be described with reference to FIG. 18.

In step S300, the main CPU 101*a* performs special electrically movable device control processing to hold a lottery for a bonus game and control a special electrically movable device. Detailed descriptions will be explained with reference to FIG. 19.

In step S400, the main CPU 101*a* performs data creation processing. Data created by this data creation processing includes: start-up hole opening and closing solenoid data for driving the start-up opening and closing solenoid 10*c*; bonus game gate opening and closing solenoid data for driving the bonus game gate opening and closing solenoid 11*c*; special symbol display device data for lightning and displaying the special symbol display device 19; reservation display data for lightning and displaying the special symbol reservation display 20; and checkout time credit data for settling credit.

In step S500, the main CPU 101*a* performs output control processing. In this processing, the main CPU 101*a* performs port output processing to output the signal generated in the step S400. In addition, the main CPU 101*a* performs display device output processing to output the special symbol display device data and the reservation display data created in the step S400. Moreover, the main CPU 101*a* performs command transmission processing to transmit a command set in the performance transmission data storage area in the main RAM 101*c*.

In step S600, the main CPU 101*a* restores the information evacuated in the step S50 to the register in the main CPU 101*a*.

(Input Control Processing)

Figure 14:
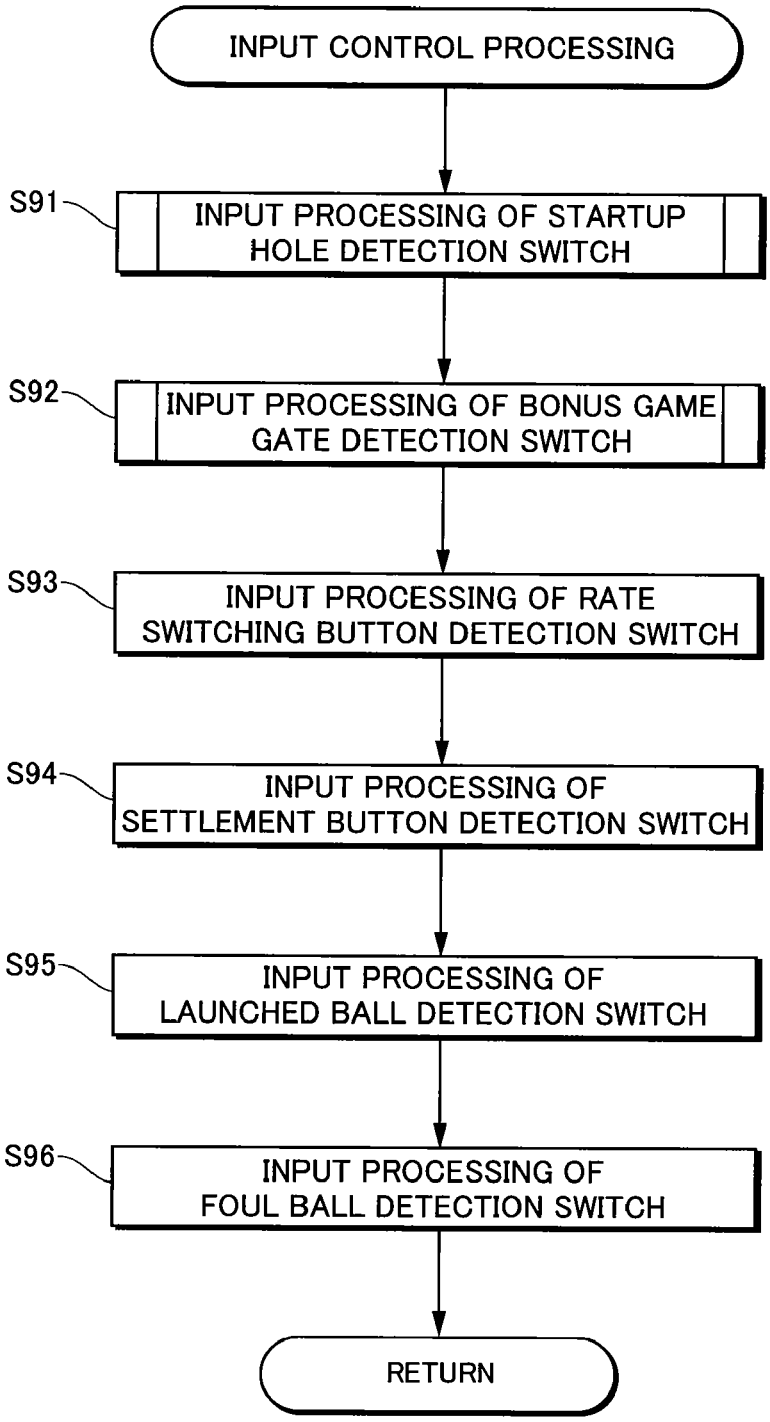
FIG. 14 shows input control processing in the main control circuit board.

Now, input control processing in the main control circuit board 101 will be described with reference to FIG. 14.

First, in step S91, the main CPU 101*a* determines whether or not a detection signal from the start-up detection switch 9*s* has been inputted, that is, whether or not a playing ball has entered the start-up hole 9, and performs start-up hole detection switch input processing to set predetermined data for determining whether or not to win a bonus game. This start-up hole detection switch input processing will be described in detail later with reference to FIG. 15.

Figure 16:
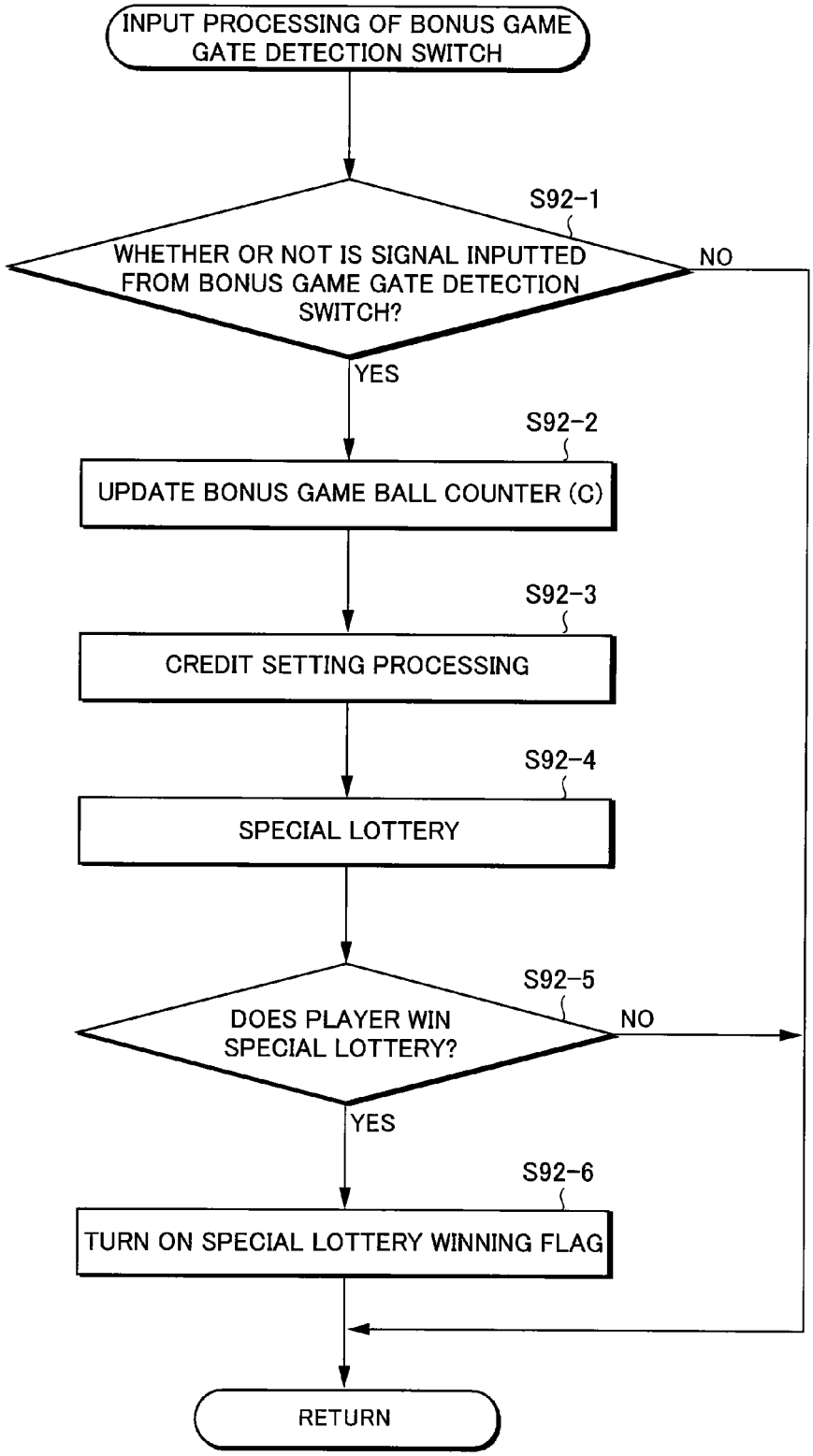
FIG. 16 shows input processing of a bonus game gate detection switch in the main control circuit board.

In step S92, the main CPU 101*a* performs bonus game gate detection switch input processing to determine whether or not a detection signal from the bonus game gate detection switch 11*s* has been inputted, that is, a playing ball has entered the bonus game gate 11, and determines the value of credit to be provided (see FIG. 16). In addition, the main CPU 101*a* adds and updates a counter in the bonus game ball counter (C) storage area that counts the playing balls received in the bonus game gate 11.

In step S93, the main CPU 101*a* determines whether or not a signal has been inputted from the rate switching button detection switch 24*s*, that is, the rate switching button 24 has been operated. In this rate switching button detection switch input processing, when it is determined that the rate switching button 24 has been operated, processing to switch the current set rate to another rate is performed. Here, rates according to the present embodiment include the following:

Rate 1: 100 playing balls can be launched by inserting 1000 yen;

Rate 2: 250 playing balls can be launched by inserting 1000 yen;

Rate 3: 500 playing balls can be launched by inserting 1000 yen; and

Rate 4: 1000 playing balls can be launched by inserting 1000 yen

That is, four rates from "rate 1" to "rate 4" are arranged. Here, rate 4 allows to the player to play a game at the lowest unit cost (one playing balls is equivalent to 1 yen), while rate 1 allows the player to play a game at the highest unit cost (one playing balls is equivalent to 10 yen). Here, "unit cost" refers to the value for one playing ball with respect to an amount of inserted money (e.g. 1000 JPY, 100 HKD and 10 USD).

In step S94, the main CPU 101*a* determines whether or not a signal from the settlement button detection switch 25*s* has been inputted, that is, the player operates to end the game in the game machine, and performs settlement button detection switch input processing to settle the credit. In this processing, information on the current credit of the player is stored as checkout time credit information.

In step S95, the main CPU 101*a* determines whether or not a signal from the launched ball detection switch 42*s* has been inputted, that is, determines whether or not a playing ball has been launched, and performs launched ball detection switch input processing to subtract the number of balls allowed to be launched (KY). In this processing, "1" is subtracted from the number of balls allowed to be launched (KY) every time the launched ball detection switch 42*s* detects a signal.

In step S96, the main CPU 101*a* determines whether or not a signal has been inputted from the foul ball detection switch 47*s*, that is, a launched ball has failed to arrive at the playfield and returned to the tray 40, and performs launched ball detection switch input processing to add the number of balls allowed to be launched (KY). In this processing, "1" is added to the number of balls allowed to be launched (YK) every time a signal is inputted from the foul ball detection switch 47*s*.

(Start-Up Hole Detection Switch Input Processing)

Figure 15:
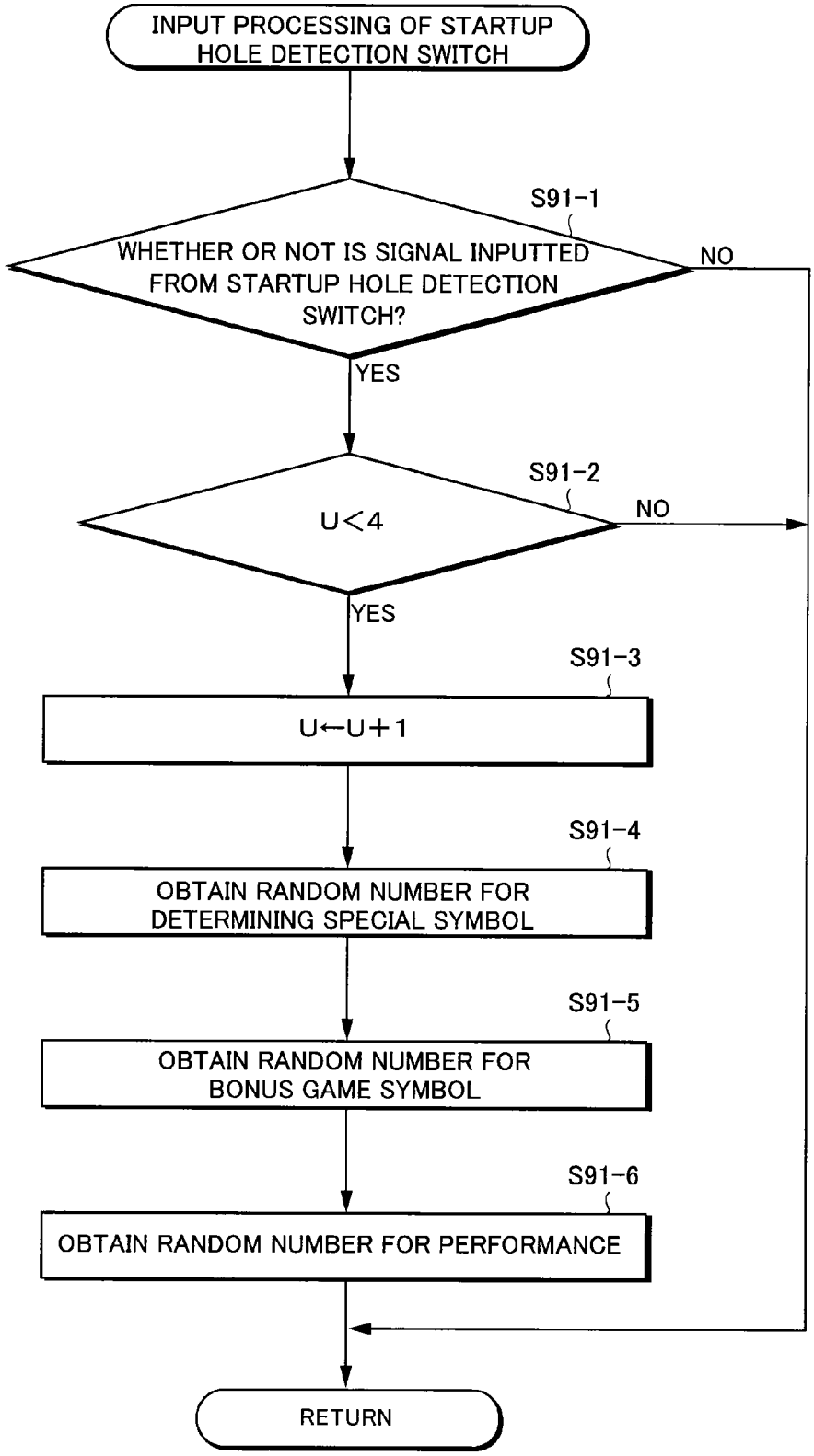
FIG. 15 shows input processing of a start-up hole detection switch in the main control circuit board.

Now, start-up hole detection switch input processing in the main control circuit board 101 will be explained with reference to FIG. 15.

First, in step S91-1, the main CPU 101*a* determines whether or not a detection signal has been inputted from the start-up hole detection switch 9*s*. If a detection signal has been inputted from the start-up detection switch 9*s*, the step moves to step S91-2, and, on the other hand, if a detection signal has not been inputted from the start-up hole detection switch 9*s*, the main CPU 101*a* ends the start-up detection switch input processing.

In the step S91-2, the main CPU 101*a* determines whether or not data set in the special symbol reservation count (U) storage area is smaller than 4. If the data set in the special symbol reservation count (U) storage area is smaller than 4, the step moves to step S91-3, and, on the other hand, if the data set in the special symbol reservation count (U) storage area is not smaller than 4, the main CPU 101*a* ends the start-up hole detection switch input processing.

In the step S91-3, the main CPU 101*a* adds "1" to the special symbol reservation count (U) storage area and stores the result.

In step S91-4, the main CPU 101*a* acquires a random number for determining a special symbol, searches empty storage parts sequentially from a first storage part in the special symbol storage area, and stores the acquired random number for determining a special symbol in an empty storage part.

In step S91-5, the main CPU 101*a* acquires a random number for a bonus game symbol, searches empty storage parts sequentially from the first storage part in the special symbol storage area, and stores the acquired random number for a bonus game symbol in an empty storage part.

In step S91-6, the main CPU 101*a* acquires a random number for performance, searches empty storage parts sequentially from the first storage part in the special symbol storage area, stores the acquired random number for performance in an empty storage part, and ends the start-up hole detection switch input processing.

By this means, the random number for determining a special symbol, the random number for a bonus game symbol and the random number for performance, are stored in the predetermined storage parts in the special symbol storage area.

(Bonus Game Gate Detection Switch Input Processing)

Now, bonus game gate detection switch input processing in the main control circuit board 101 will be explained with reference to FIG. 16.

First, in step S92-1, the main CPU 101*a* determines whether or not a detection signal has been inputted from the bonus game gate detection switch 11*s*. If a detection signal has been inputted from the bonus game gate detection switch 11*s*, the step moves to step S92-2, and, on the other hand, when a detection signal has not been inputted from the bonus game gate detection switch 11*s*, the main CPU 101*a* ends the bonus game gate detection switch input processing.

In the step S92-2, the main CPU 101*a* adds the counter in the bonus game ball counter (C) storage area that counts playing balls received in the bonus game gate 11, and updates the result.

In step S92-3, the main CPU 101*a* performs credit setting processing. In this processing, a predetermined value of credit is provided. With the present embodiment, a prescribed value "10" of credit is provided every time a playing ball enters the bonus game gate.

Figure 21A:
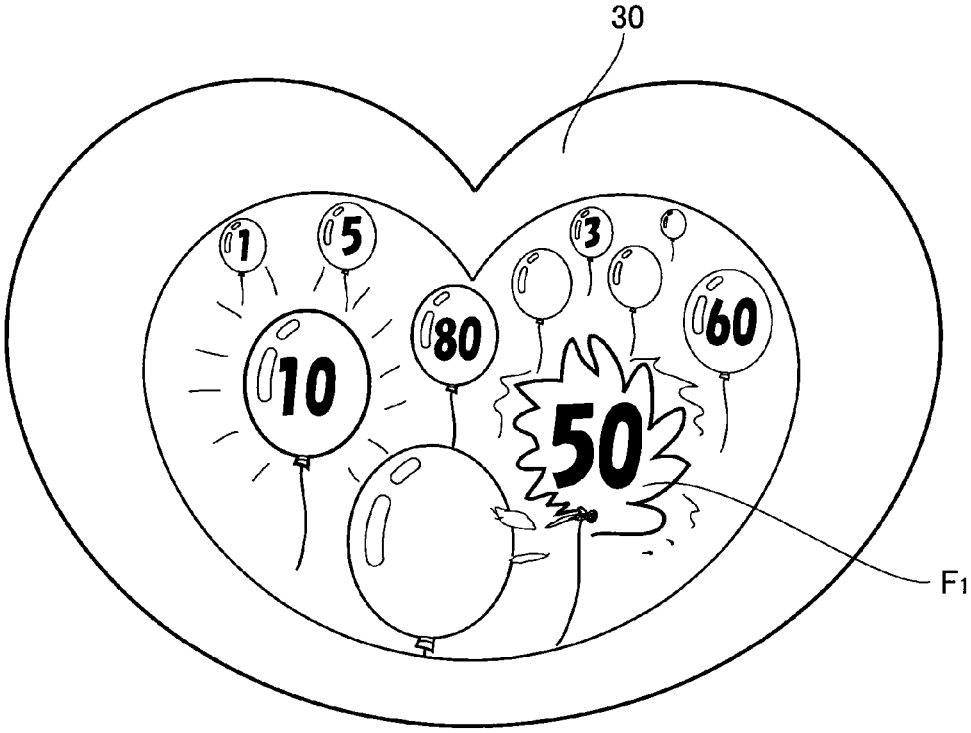
FIG. 21 shows an example of the content of performance in a credit control circuit board.
Figure 21B:
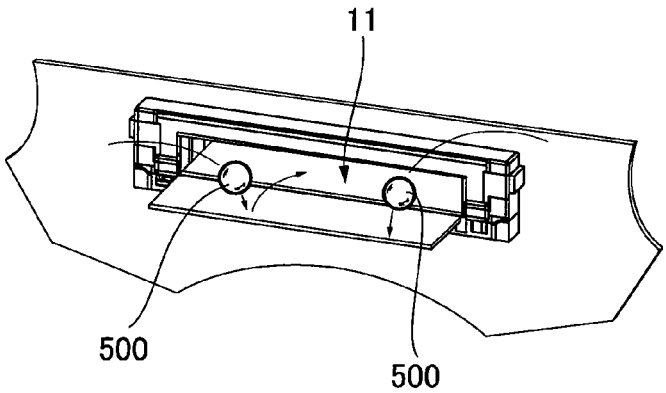

Here, in the step S400, credit data is created based on the determined value of credit, and, in the step S500, the credit data is transmitted to the credit control circuit board 200. Then, the credit control circuit board 200 carries out bonus game performance on the submonitor 30 based on the received credit data. For example, FIG. 21A shows a performance image representing an example of bonus game performance on the submonitor 30. In the figure, balloons numbered "10", "50", "60" and "80" . . . fly, and one of them has burst. As shown in FIG. 21B, this performance has a scenario where a balloon bursts every time a playing ball enters the bonus game gate, and the number on the burst balloon is added to the value of credit. This performance scenario can make the player feel as if it is possible to acquire random values of credit in a bonus game.

In the step S92-3, the main CPU 101*a* holds a special lottery. This "special lottery" is a lottery to determine whether or not the player can acquire a right to play a "special bonus game" in addition to this bonus game. With the present embodiment, if the player wins a special lottery, the player can play another bonus game having the same scenario as this bonus game, or another bonus game having a completely different scenario. Then, the probability of winning a special bonus game is set to a significantly low rate such as "1/10000". In addition, this special lottery is not held during a special bonus game, but is held at the time of detection by the start-up hole detection switch 9*s*.

Here, this "special bonus game" may be so-called jackpot (including progressive jackpot in a broad sense), and may provide a right to participate in jackpot (jackpot participation right).

Figure 22A:
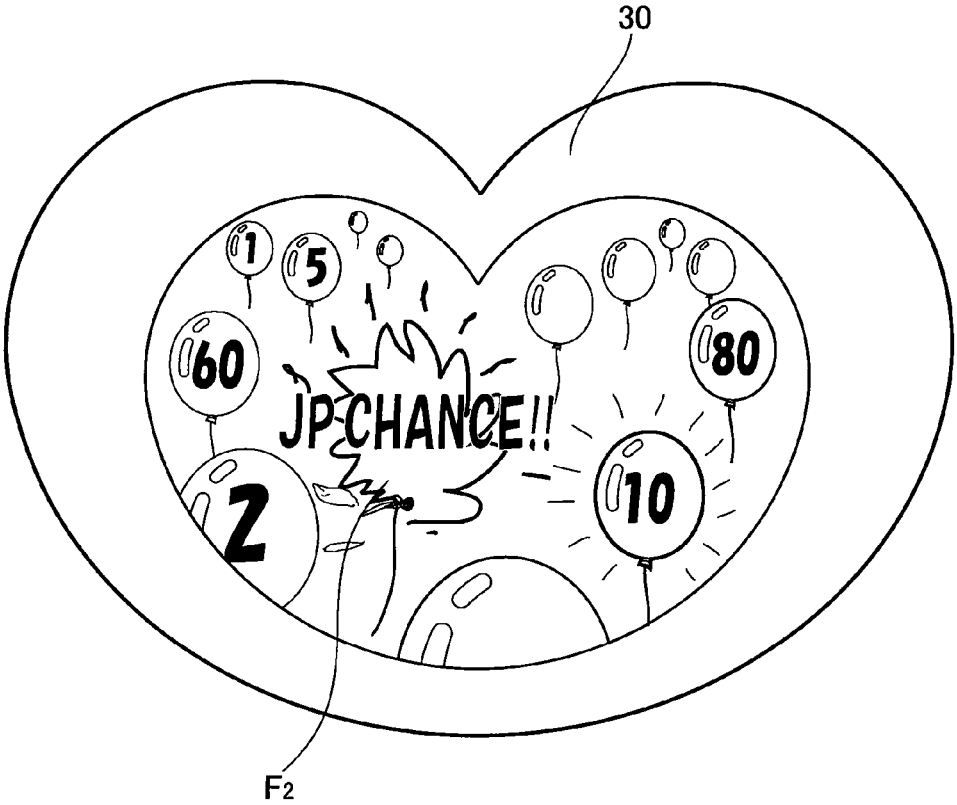
FIG. 22 shows an example of the content of performance in the credit control circuit board.
Figure 22B:
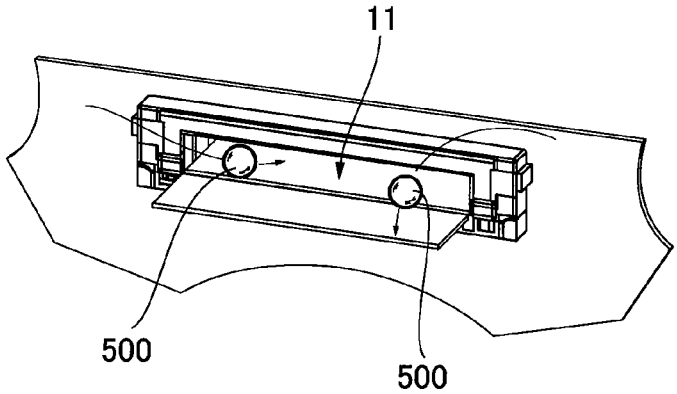

In addition, by giving suggestion or information about a special lottery in the above-described bonus game performance, it is possible to provide more exciting performance. For example, in FIG. 22A, a word "JPCHANCE!!" is displayed when balloon bursts, in the bonus game performance explained with reference to FIG. 21A. By this means, it is possible to give to the player a great expectation to not only add credit but also get an additional game value. This suggestion or information may be provided not only at the time the player wins a special lottery, but may be provided randomly or by lottery.

In step S92-4, the main CPU 101*a* determines whether or not the player has won a special lottery in the step S92-3. When the player has not won a special lottery, the main CPU 101*a* ends the bonus game gate detection switch input processing, and, on the other hand, when the player has won a special lottery, the main CPU 101*a* turns on a flag (special lottery winning flag) in a special winning flag storage area provided in the main RAM 101*c*. Here, in the present embodiment, a special bonus game of corresponds to an example of the second game value.

(Play Start Control Processing)

Figure 17:
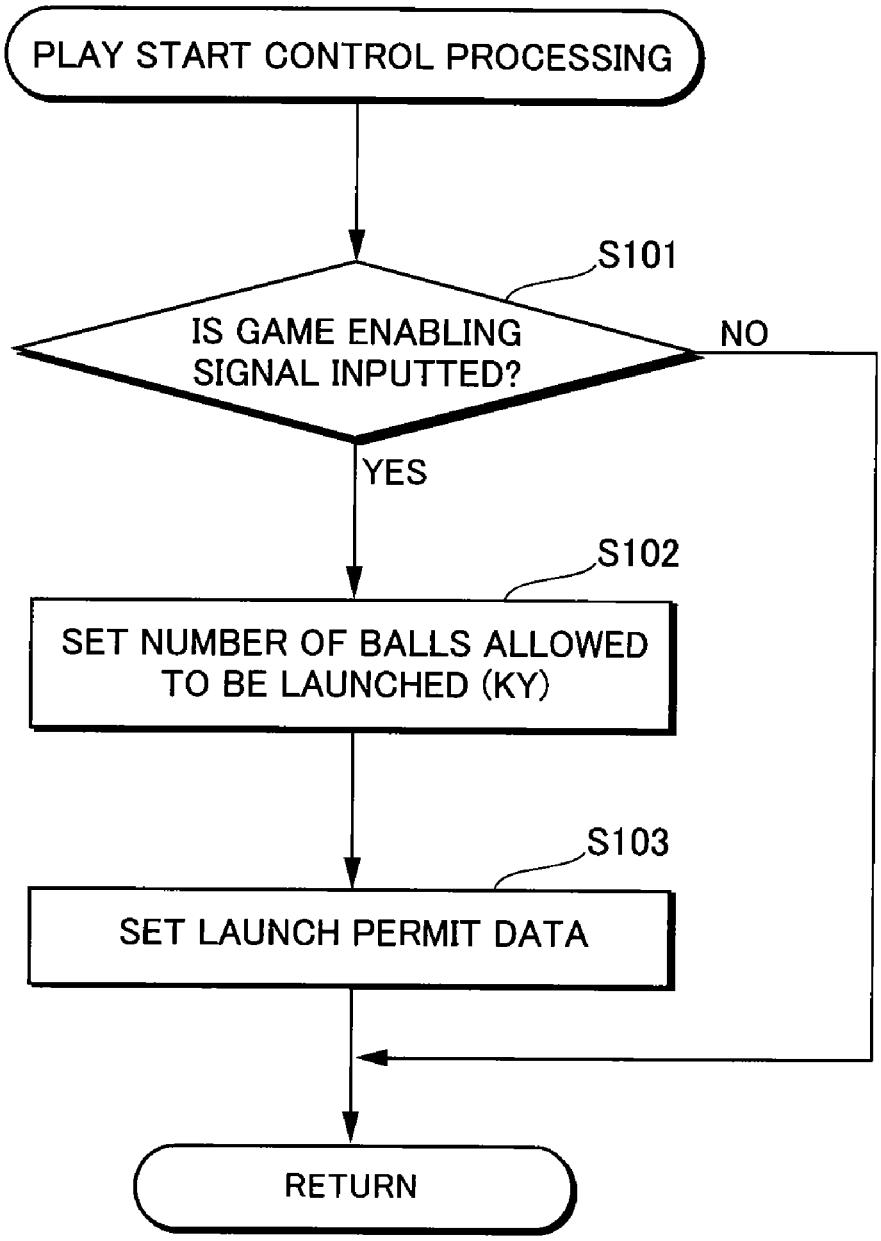
FIG. 17 shows play start control processing in the main control circuit board.

Now, play start control processing in the main control circuit board 101 will be explained with reference to FIG. 17.

In step S101, the main CPU 101*a* determines whether or not a game enabling signal to enable a game has been inputted from the credit control circuit board 200, and, when the main CPU 101*a* determines that a game enabling signal has been inputted, the step moves to step S102, and, on the other hand, when the main CPU 101*a* does not determine that a game enabling signal has been inputted, the main CPU 101*a* ends the play start control processing.

In step S102, the main CPU 101*a* sets the number of balls allowed to be launched (KY) corresponding the credit, in a KY storage area provided in the main RAM 101*c*, according the credit information contained in the game enabling signal.

In step S103, the main CPU 101*a* sets launch permit data in launch permit data storage area in order to permit the launch control circuit board 106 to launch playing balls, and ends the play start control processing.

(Play End Control Processing)

Figure 18:
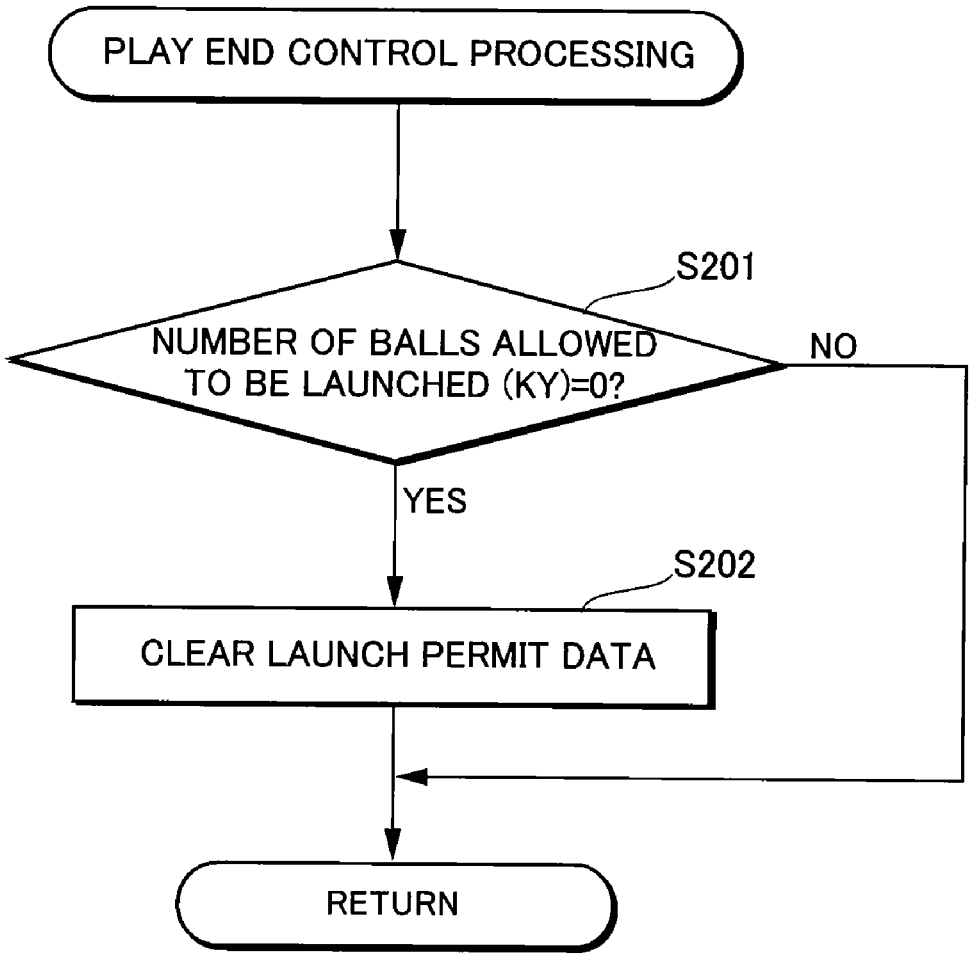
FIG. 18 shows play end control processing in the main control circuit board.

Now, play end control processing in the main control circuit board 101 will be described with reference to FIG. 18.

In step S201, the main CPU 101*a* determines whether or not the number of balls allowed to be launched (KY) is "0" (i.e. "KY=0"). When determining that KY is not "0", the main CPU 101*a* ends the play end control processing, and, on the other hand, when the main CPU 101*a* determines that KY is "0", the step moves to step S202.

In the step S202, the main CPU 101*a* clears the launch permit data to end the play end control processing. Launching is stopped by clearing the launch permit data in the step S202.

Here, any technique may be used for stopping launching based on play end control processing as long as a playing ball is not launched even if the player operates the operation handle 3, for example, a configuration is possible where detection by the touch sensor 3*s* is disabled, or the voltage value of the launching volume adjusting part 3*a* is not read.

(Special Electrically Movable Device Control Processing)

Figure 19:
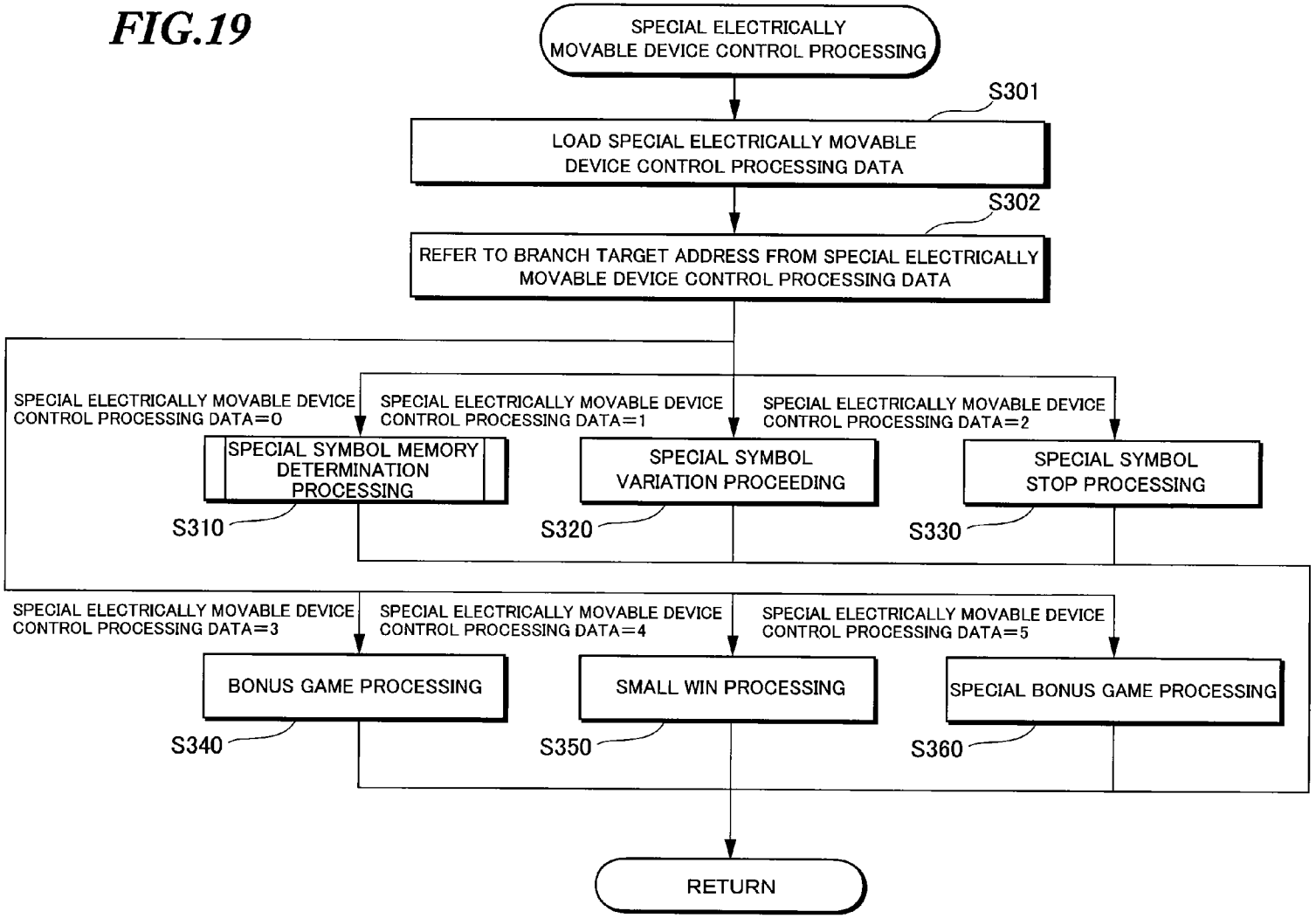
FIG. 19 shows special electrically movable device control processing in the main control circuit board.

Now, special electrically movable device control processing will be explained with reference to FIG. 19.

The main CPU 101*a* loads the value for special electrically movable device control processing data in step 301; refers to a branch target address from the loaded special electrically movable device control processing data in the step 302; moves the step to special symbol memory determination processing (step S310) when the special electrically movable device control processing data is equal to 0; moves the step to special symbol variation processing (step S320) when the special electrically movable device control processing data is equal to 1, moves to the step to special symbol stop processing (step S330) when the special electrically movable device control processing data is equal to 2; moves the step to bonus game processing (step S340) when the special electrically movable device control processing data is equal to 3; moves the step to small win processing (step S350) when the special electrically movable device control processing data is equal to 4; and moves to the step to special bonus game processing (step S360) when the special electrically movable device control processing data is equal to 5. This "special electrically movable device control processing data" is set in each subroutine in special electrically movable device control processing according to need, as described later, so that the subroutines required for the game are processed in an appropriate manner.

In the step S310, the main CPU 101*a* performs special symbol memory determination processing to hold a lottery for a bonus game and determine the special symbol to be stopped and displayed. Detailed descriptions will be explained with reference to FIG. 20.

In the special symbol variation processing in the step S320, the main CPU 101*a* performs processing to determine whether or not a variation period of time for special symbols has passed. To be more specific, the main CPU 101*a* determines whether or not the variation period of time for special symbols determined in the step S310 has passed (i.e. the special symbol time counter=0?), and, when determining that the variation period of time for special symbols has not passed, the main CPU 101*a* ends this special symbol variation processing while keeping "special electrically movable device control processing data=1", and performs the next subroutine. When determining that the variation period of time for special symbols has passed, the main CPU 101*a* clears the special symbol variation display data, and stops and displays the special symbol determined in the step S310 on the special symbol display device 19. By this means, the special symbol is stopped and displayed on the special symbol display device 19, and therefore the result of the determination of a bonus game is informed to the player. Finally, the main CPU 101*a* changes "special electrically movable device control processing data=1" to "special electrically movable device control processing data=2" to prepare to move the step to special symbol stop processing, and ends the special symbol variation processing.

In the special symbol stop processing in step S330, the main CPU 101*a* performs processing to identify the special symbol stopped and displayed. To be more specific, the main CPU 101*a* first determines whether or not the special symbol stopped and displayed is a bonus game symbol. When determining that the special symbol is a bonus game symbol, the main CPU 101*a* changes "special electrically movable device control processing data=2" to "special electrically movable device control processing data=3" to prepare to move the step to bonus game processing, and ends the special symbol stop processing. On the other hand, when determining that the special symbol is not a bonus game symbol, the main CPU 101*a* changes "special electrically movable device control processing data=2" to "special electrically movable device control processing data=0" to prepare to move the step to special symbol memory determination processing, and ends the special symbol stop processing.

In bonus game processing in step S340, the main CPU 101*a* drives the bonus game gate opening and closing solenoid 11*c* and performs processing to open and close the bonus game gate 11. To be more specific, the main CPU 101*a* outputs driving data for the bonus game gate opening and closing solenoid 11*c* to open the bonus game gate opening and closing part 11*b*, sets an opening period of time 29.5 seconds in the special game timer counter, and opens the bonus game gate opening and closing part 11*b* for up to 29.5 seconds. If a predetermined number of playing balls enter the bonus game gate 11 during this opening period of time (for example, the bonus game ball counter=5), or the maximum opening period of time has passed (the special game timer counter=0), the main CPU 101*a* stops output of driving data for the bonus game gate opening and closing solenoid 11*c* and closes the bonus game gate opening and closing part 11*b*. By this means, one round game ends. This control of a round game is performed repeatedly fifteen times. After a total number of fifteen round games have been performed, if the special winning flag has not turned on, the main CPU 101*a* changes "special electrically movable device control processing data=3" to "special electrically movable device control processing data=1" to prepare to move the step to special symbol memory determination processing, and ends the bonus game processing. On the other hand, if the special winning flag has been turned on, the main CPU 101*a* changes "special electrically movable device control processing data=3" to "special electrically movable device control processing data=5" to prepare to move the step to special bonus game processing, and ends the bonus game processing.

In small win processing in step S350, the main CPU 101*a* adds a predetermined value of credit corresponding to a small win symbol and updates the result. After that, the main CPU 101*a* changes "special electrically movable device control processing data=4" to "special electrically movable device control processing data=0" to prepare to move the step to special symbol memory determination processing, and ends the small win processing.

In special bonus game processing in step S360, the main CPU 101*a* performs again the bonus game having been played just before, or performs another bonus game having a completely different scenario. Then, when the bonus game ends, the main CPU 101*a* changes "special electrically movable device control processing data=5" to "special electrically movable device control processing data=0" to prepare to move the step to special symbol memory determination processing, and ends the special bonus game processing.

(Special Symbol Memory Determination Processing)

Figure 20:
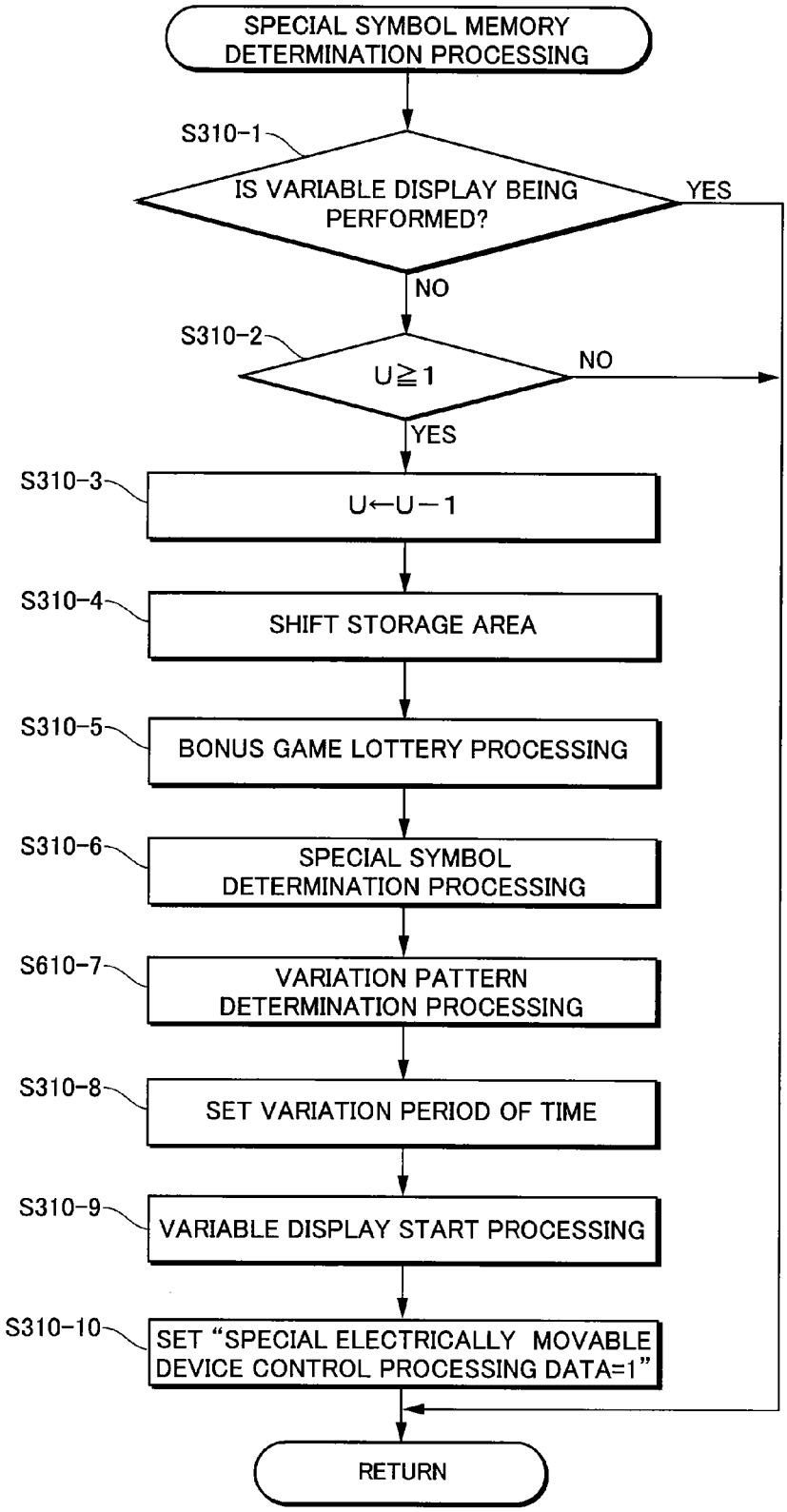
FIG. 20 shows special symbol memory determination processing in the main control circuit board.

Now, special symbol memory determination processing in the main control circuit board 101 will be described with reference to FIG. 20.

In step S310-1, the main CPU 101*a* determines whether or not special symbols are being variably displayed. Here, when special symbols are being variably displayed (the special symbol time counter≠0), the main CPU 101*a* ends the special symbol memory determination processing, and, on the other hand, when special symbols are not being variably displayed (the special symbol time counter=0), the main CPU 101*a* moves the step to step 310-2.

In the step S310-2, the main CPU 101*a* determines whether or not there are one or more special symbol reservation count (U) storage areas unless special symbols are not being variably displayed. When determining that there are one or more special symbol reservation count (U) storage areas, the main CPU 101*a* moves the step to step S310-3, and, on the other hand, when determining that there are not one or more special symbol reservation count (C) storage areas, ends the special symbol memory determination processing.

In the step S310-3, the main CPU 101*a* subtracts "1" from the value stored in the special symbol reservation count (U) storage area and stores the result.

In step S310-4, the main CPU 101*a* performs shift processing on the data stored in the special symbol reservation storage area corresponding to the special symbol reservation count (U) storage area subject to the subtraction in the step S310-2 to the step S310-3. To be more specific, the main CPU 101*a* shifts data stored in each of the first storage part to the fourth storage part in the special symbol storage area, to the immediately preceding storage part. Here, the data stored in the first storage part is shifted to a determination storage area (the zero storage part). At this time, the data stored in the first storage part is written to the determination storage area (the zero storage part), and the data having already been written to the determination storage area (the zero storage part) is deleted from the special symbol reservation storage area. By this means, the random number for determining a special symbol, the random number for a bonus game symbol and the random number for performance which have been used in the previous game, are deleted.

In step S310-5, the main CPU 101*a* performs bonus game lottery processing, based on the random number for determining a special symbol written in the determination storage area (the zero storage part) in the special symbol reservation storage area in the step S310-4. In this bonus game lottery processing, the main CPU 101*a* refers to the bonus game determination table shown in FIG. 9, and determines whether the random number for determining a special symbol corresponds "win" or "small win".

In step S310-6, the main CPU 101*a* performs special symbol determination processing to determine the special symbol to be stopped and displayed. In this special symbol determination processing, when determining that the result of a lottery for a bonus game is win, the main CPU 101*a* refers to the symbol determination table shown in FIG. 10A and determines data for the bonus game symbol to be stopped, based on the random number for a bonus game symbol, and, when determining that the result is small win, refers to the symbol determination table shown in FIG. 10B and determines data for the small win symbol to be stopped, based on the random number for a small win symbol. Meanwhile, when determining that the result is loss, the main CPU 101*a* refers to the symbol determination table shown in FIG. 10C and determines data for the loss symbol to be stopped. After that, the main CPU 101*a* sets the determined data for the symbol to be stopped, in a stopped symbol data storage area.

In step S310-7, the main CPU 101*a* performs variation pattern determination processing to determine a variation mode of the special symbol. In the variation pattern determination processing, the main CPU 101*a* refers to a variation pattern determination table (not shown) and determines a variation pattern, based on the result of the lottery for a bonus game, the kind of the special symbol, the special symbol reservation count (U), and the acquired random number for performance. Then, the main CPU 101*a* sets a variation pattern specifying command corresponding to the determined variation pattern in the performance transmission data storage area.

In step S310-8, the main CPU 101*a* sets, in the special symbol time counter, a variation period of time (counter value) based on the variation pattern determined in the step S310-7. Here, the special symbol time counter is subject to subtraction processing per 4 milliseconds in the step S60.

In step S310-9, the main CPU 101*a* performs variable display start processing to set variable display data for the special symbol in order to make the special symbol display device 19 perform variable display (lightning of LEDs) of the special symbol. By this means, when the variable display data for the special symbol is set, the special symbol display device data for lightning LEDs is created in an appropriate manner in the step S400 and the created data is outputted in step S500, so that variable display of the special symbol display device 19 is performed. This variable display of the special symbol is continuously performed for the variation period of time set in the step S310-8.

In step S310-10, the main CPU 101*a* moves the step to special symbol variation processing in step S320 by setting "special electrically movable device control processing data=1", and ends the special symbol memory determination processing.

Next, a summary of the performance control circuit board 102 will be briefly explained.

Upon receiving a command transmitted from the main control circuit board 101, the performance control circuit board 102 performs command reception interrupt processing and stores the received command in a reception buffer.

Then, the sub-CPU 102*a* in the performance control circuit board 102 analyzes the received commands by timer interrupt processing performed in the performance control circuit board 102 per 2 milliseconds, and creates various data corresponding to respective commands. After that, the generated various data is transmitted to the image control circuit board 105 and the lamp control circuit board 104.

To be more specific, upon receiving a variation pattern specifying command from the main control circuit board 101, the sub-CPU 102*a* refers to the performance pattern determination table stored in the sub-ROM 102*b*, and determines a performance pattern for which the performance display device 13, the audio output device 18, the performance illumination device 16 and the performance object device 15 carry out predetermined performance. Then, the sub-CPU 102*a* creates performance data corresponding to the determined performance pattern, and transmits the performance data to the image control circuit board 105 and the lamp control circuit board 104.

In addition, upon receiving a performance symbol specifying command indicating a bonus game, from the main control circuit board 101, the sub-CPU 102*a* refers to the performance symbol determination table for a bonus game shown in FIG. 11, and determines performance symbol data based on the received performance symbol specifying command. Then, the sub-CPU 102*a* transmits the determined performance symbol data to the image control circuit board 105 and the lamp control circuit board 104. By this means, a combination of the same specific performance symbols 70 are stopped and displayed on the performance display device 13. Here, in a case of a performance symbol specifying command indicating loss, a performance symbol determination table for loss is stored (not shown), which is configured to avoid the combination of the same specific performance symbols 70.

Next, a summary of the image control circuit board 105 and the lamp control circuit board 104 will be briefly explained.

When data from the performance control circuit board 102 is inputted to the image control circuit board 105, an audio CPU reads an audio output device control program from an audio ROM and controls audio outputted from the audio output device 18, and an image CPU reads a program from an image ROM and controls image display of the performance display device 13 based on the received performance command.

Likewise, upon receiving data from the performance control circuit board 102, the lamp control circuit board 104 reads a performance object device operation program based on the received data to control operation of the performance object device 15, and reads a performance illumination device control program based on the received performance data to control the performance illumination device 16.

Figure 23:
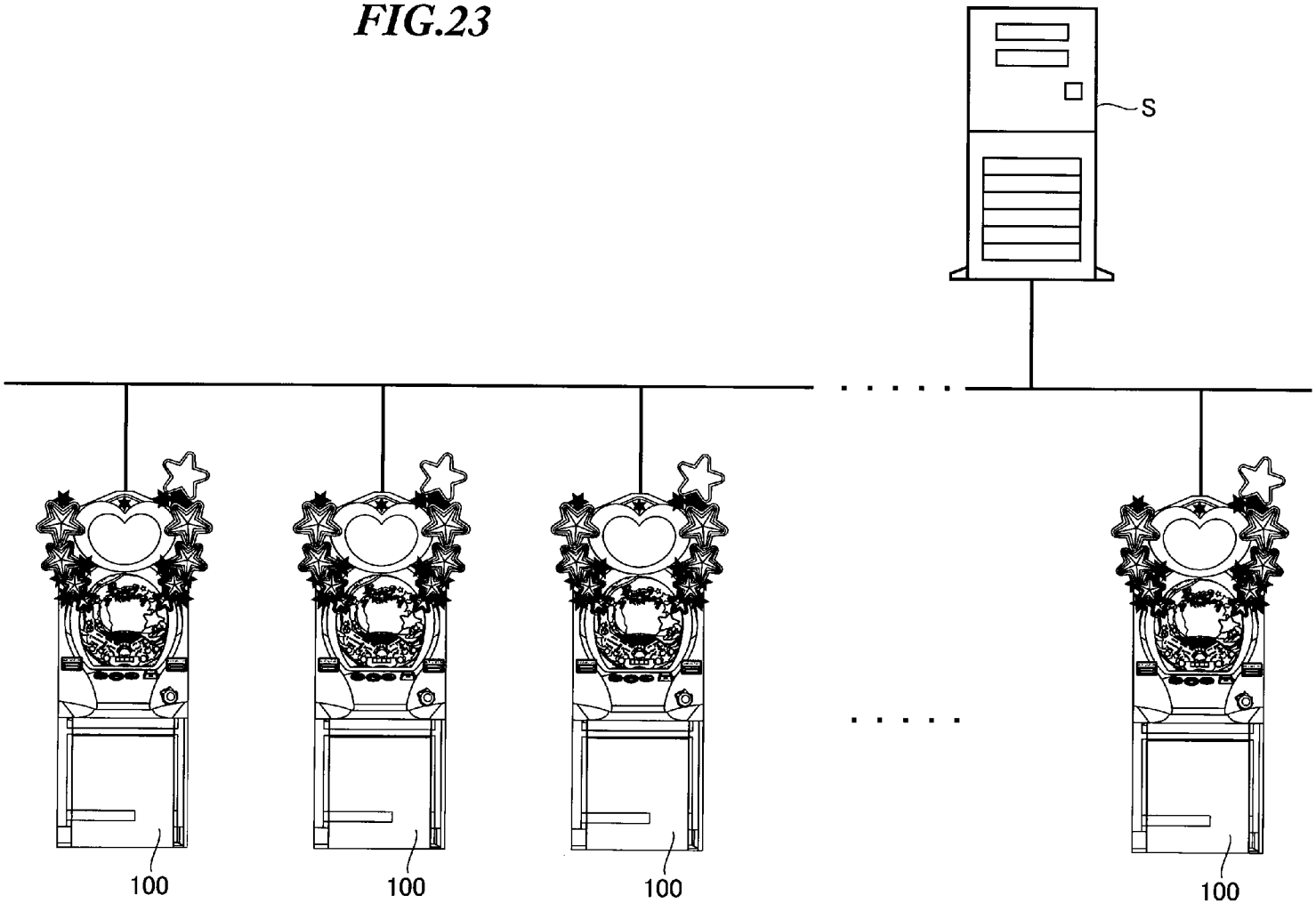
FIG. 23 shows a client-server type of configuration.

Here, although with the present embodiment, a configuration including a single game machine 100 (so-called standalone game machine) has been explained, the present invention is not limited to this. For example, as shown in FIG. 23, another configuration is possible, which provides a client-server game system including a plurality of game machines 100 and a server (central control device). By this means, credit for jackpot can be accumulated by a plurality of game machines 100, so that it is possible to provide jackpot with a significantly higher dividend than a standalone type game machine.

Here, although with the present embodiment, a configuration has been explained where an inserted mediums is paper money (or hard money), the present invention is not limited to this. For example, an inserted medium may be a token such as a medal or a coin used in a game machine, or money information and point information stored in an information recoding medium (e.g. an IC card and a coin).

Here although with the present embodiment, a configuration has been explained where a predetermined value of credit is provided for each of a bonus game and a small win, the present invention is not limited to this. For example, a prize such as an article, or a ticket that can be exchanged for this prize is possible. The same applies to a special bonus game.

Here, although with the present embodiment, a configuration has been explained where a special lottery is held at the time a playing ball enters the bonus game gate 11, the present invention is not limited to this. For example, a special lottery can be held when a playing ball enters the start-up hole 9 or at the time of a lottery for a bonus game. Here, even if a special lottery is held at the time a playing ball enters the start-up hole 9, or at the time of a lottery for a bonus game, it is possible to make the player feel as if a special lottery is held during a bonus game.

In addition, although with the present embodiment, a configuration has been explained where respective values of credit for win and small win are determined in advance as "6000" and "3000", the present invention is not limited to this. For example, another configuration is possible where the values of credit are set in a predetermined range (the upper limit to the lower limit), such as "3000 to 5000", "10 to 500", or "up to 8000", and a lottery is held within the range to determine the value of credit. In addition, the above-described predetermined range is not set but the values of credit to be provided may be completely randomized.

Here, although with the present embodiment, a configuration has been explained where a predetermined value of credit is provided in credit setting processing, the present invention is not limited to this. Another configuration is possible where, for example, the values of credit are determined by lotteries in a bonus game, not being completely randomized, and finally, the total value of the credit should match the value of the credit for the bonus game.

The invention claimed is:

1. A game machine comprising: a game board provided with a playfield on which playing balls cascade downward;

a ball receiving hole detection part configured to detect whether or not a playing ball enters a ball receiving hole provided in the playfield;

a special movable bonus game gate device configured to be able to switch between an open state where the playing ball easily enters a special bonus game gate provided in the playfield and a closed state where the playing ball hardly enters the special bonus game gate;

a lottery part configured to hold a lottery in which one result of the lottery is obtained from a plurality of results at least including a bonus game, the bonus game opening the special movable bonus game gate device when the ball receiving hole detection part detects the playing ball entering; and a game value providing part configured to provide a first game value based on the special movable bonus game gate device being open when the result of the lottery by the lottery part is to acquire the bonus game; and a special lottery part configured to hold a special lottery to determine whether or not to provide a second game value different from the first game value, in addition to the first game value which is provided by the game value providing part when the result of the lottery by the lottery part is to acquire the bonus game; the game machine further comprising a special bonus game gate detection part configured to detect whether or not the playing ball enters the special bonus game gate, wherein:

the game value providing part provides the first game value on condition that the special bonus game gate detection part detects the playing ball entering; and the special lottery part holds the special lottery to determine whether or not to provide the second game value different from the first game value, in addition to the first game value which is provided by the game value providing part, on condition that the special bonus game gate detection part detects the playing ball entering.

2. The game machine according to claim 1, further comprising a special value providing part configured to provide one of the first game value and a third game value different from the first game value, when it is determined that the second game value is provided at the special lottery by the special lottery part.

3. The game machine according to claim 1, further comprising a special value providing part configured to provide one of the first game value and a third game value different from the first game value, when it is determined that the second game value is provided at the special lottery by the special lottery part.

4. The game machine according to claim 1, further comprising a lottery right providing part configured to give a right to hold a second special lottery to determine whether or not to provide one of the first game value and a third game value when it is determined that the second game value is provided at the special lottery by the special lottery part.

5. The game machine according to claim 2, wherein the special value providing part provides a game medium which can be converted into a predetermined number of playing balls as the third game value.

6. The game machine according to claim 3, wherein the special value providing part provides a game medium which can be converted into a predetermined number of playing balls as the third game value.

7. The game machine according to claim 2, wherein the special value providing part provides a game medium which cannot be converted into a predetermined number of playing balls as the third game value.

8. The game machine according to claim 3, wherein the special value providing part provides a game medium which cannot be converted into a predetermined number of playing balls as the third game value.

9. The game machine according to claim 1, further comprising:

a variable display part including a variable display portion configured to be able to variably display a plurality of kinds of identification symbols in a display area, the identification symbols being arranged in a predetermined order; and a variable display control part configured to variably display the identification symbols on the variable display portion at the time of start of the lottery by the lottery part, and stop and display a combination of the identification symbols corresponding to the result of the lottery by the lottery part on the variable display portion after a predetermined period of time has elapsed, wherein the variable display control part stops and displays a first combination when the result of the lottery by the lottery part is to acquire the bonus game, the first combination including one of a combination of a same identification symbols and a plurality of identification symbols, which corresponds to the bonus game.

10. The game machine according to claim 1, further comprising a performance execution part in one of the variable display part and a display part different from the variable display part, the performance execution part executing a special lottery suggestion performance which suggests that the special lottery is being held.

11. The game machine according to claim 1, further comprising a performance execution part in one of the variable display part and a display part different from the variable display part, the performance execution part executing a special lottery suggestion performance which suggests that the special lottery is being held.

12. The game machine according to claim 1, wherein the special lottery part holds the special lottery in addition to the lottery by the lottery part when the ball receiving hole detection part detects the playing ball entering.

* * * * *